US005983044A

United States Patent [19]

Kodama et al.

[11] Patent Number: 5,983,044

[45] Date of Patent: Nov. 9, 1999

[54] IMAGE FORMING APPARATUS WITH TRANSFER EFFICIENCY CONTROL

[75] Inventors: Hideaki Kodama, Okazaki; Kazuyuki Fukui, Toyohashi, both of Japan

[73] Assignee: Minolta Co., Ltd., Osaka, Japan

[21] Appl. No.: 08/907,123

[22] Filed: Aug. 6, 1997

[30] Foreign Application Priority Data

Aug. 7, 1996 [JP] Japan ..... 8-208520

[51] Int. Cl.[6] ..... G03G 15/00

[52] U.S. Cl. ..... 399/49; 399/55; 399/66

[58] Field of Search ..... 399/66, 49, 55, 399/44, 72

[56] References Cited

U.S. PATENT DOCUMENTS

| | | | |
|---|---|---|---|
| 5,060,013 | 10/1991 | Spence | 399/72 |
| 5,241,347 | 8/1993 | Kodama | 399/49 |
| 5,291,253 | 3/1994 | Kumasaka et al. | 399/66 |
| 5,294,959 | 3/1994 | Nagao et al. | 399/44 |
| 5,296,903 | 3/1994 | Suzuki et al. . | |
| 5,333,037 | 7/1994 | Inoue et al. | 399/49 |
| 5,532,794 | 7/1996 | Tokuyama et al. | 399/49 |
| 5,581,221 | 12/1996 | Kawai et al. | 399/49 |
| 5,708,917 | 1/1998 | Kawai et al. | 399/58 |
| 5,761,568 | 6/1998 | Haragakiuchi et al. . | |

FOREIGN PATENT DOCUMENTS

| | | |
|---|---|---|
| 04149464 | 5/1992 | Japan . |
| 04204149 | 7/1992 | Japan . |
| 04363650 | 12/1992 | Japan . |
| 05134561 | 5/1993 | Japan . |
| 05289463 | 11/1993 | Japan . |
| 06043719 | 2/1994 | Japan . |

*Primary Examiner*—Robert Beatty
*Attorney, Agent, or Firm*—McDermott, Will & Emery

[57] ABSTRACT

In order to control development condition and/or transfer condition for stable image forming, toner patterns of the same density are formed on a photoconductor and are transferred onto a paper or the like while changing the transfer current. Then, the transfer efficiencies of the toner patterns are measured. Other characteristics such as the resistance of the paper and charge of toners may also be monitored. Then, the development condition and/or transfer condition is controlled according to the detected data.

26 Claims, 22 Drawing Sheets

IMAGE FORMING APPARATUS WITH TRANSFER EFFICIENCY CONTROL

BACKGROUND OF THE INVENTION

1. Field of the Invention

This invention relates to an image forming apparatus such as a copying machine which uses an electrophotographic process.

2. Description of Prior Art

In an image forming apparatus which uses an electrophotographic process, it is desirable that an image is formed stably or an image of a particular density is reproduced on a paper for the same image data. In order to reproduce an image stably, it is known to control development conditions based on toner density before a copy operation is started or when a copy mode is set. The toner density is measured on a toner pattern formed on a photoconductor. It is also known to control a development condition based on the toner density of a toner pattern formed on a photoconductor in predetermined conditions and transferred onto a paper at a predetermined transfer current (for example, Japanese Patent laid open Publication 5-134561/1993). The development condition may be, for example, toner density in a development unit, development bias voltage applied to a surface of development sleeve, development interval or the like.

When the amount of charges on toners decreases due to deterioration or the like, toners on the photoconductor are reversely charged in a transfer part of the copying machine, and toners reversely charged are remained on the photoconductor after the toner image is transferred on a paper. This decreases transfer efficiency. In this case, the transfer efficiency can be optimized by controlling the development condition to increase the amount of toner charges. The reverse charging of toners also occurs when the resistance of the paper onto which a toner image is transferred decreases in the environment of high humidity. In this case, the best transfer efficiency or the transfer current for the maximum density is affected. Therefore, besides the control of the development condition to increase the amount of the toner charges, it may be necessary further to control the transfer current. However, prior art image forming apparatuses do not take into account reverse charging due to a change in the resistance of a paper under high humidity environment. Therefore, they cannot decide whether the reverse charging of toners is caused by decrease in toner charges due to deterioration or by decrease in the resistance of the paper under the high humidity environment. Then, in the high humidity environment, the development condition and image forming conditions including the transfer current cannot be controlled appropriately, and an image cannot be reproduced stably on a paper.

SUMMARY OF THE INVENTION

An object of the present invention is to provide an image forming apparatus which forms an electrophotographic image stably.

In one aspect of the present invention, in order to form a stable image in an electrophotographic image forming apparatus, a plurality of latent images with the same optical intensity are formed on a photoconductor and are developed to form a plurality of toner image on the photoconductor. Then, they are transferred onto a paper while changing transfer current of a transfer device for each of the toner patterns. As to the transfer each of the toner patterns transferred onto the paper, a detector detects transfer efficiency. The transfer efficiency of each of the toner patterns is detected, for example, based on an amount of toners of the toner patterns transferred onto the paper or based on an amount of toners remained on the photoconductor after transfer. Then, a development controller controls a development condition of a development unit based on the transfer efficiencies of the toner patterns detected by the detector. For example, a development bias voltage of the development unit is controlled. Another characteristic such as humidity is detected by a humidity sensor, and the transfer controller controls a transfer condition according to the humidity detected.

In a second aspect of the invention, besides the above-mentioned transfer efficiencies for each of the toner patterns, a resistance detector detects resistance of the paper, and a charge detector detects an amount of charges of the toner patterns formed on the photoconductor before transfer. Then, a controller controls a development condition of a development unit and/or a transfer condition of a transfer device based on the transfer efficiencies of the toner patterns and at least one of the resistance and the amount of toner charges. Preferably, the controller controls the development condition when the transfer efficiencies satisfy a predetermined condition and the amount of toner charges is smaller than a predetermined value, and the controller controls the transfer condition when the resistance of the paper is smaller than a predetermined value.

In a third aspect of the invention, a plurality of toner patterns on a photoconductor are transferred onto a paper and onto a film, respectively, while changing transfer current of said transfer device for each of the toner patterns. Then, a detector detects transfer efficiencies on transfer onto the paper and on transfer onto the film. The transfer efficiencies on the transfer onto the paper are compared with the counterparts on transfer onto the film, and a controller controls a development condition of a development unit and a transfer condition of a transfer device based on the comparison.

An advantage of the present invention is that the amount of toners remained on the photoconductor after transfer can be decreased and the transfer of a toner image is performed excellently.

BRIEF DESCRIPTION OF THE DRAWINGS

These and other objects and features of the present invention will become clear from the following description taken in conjunction with the preferred embodiments thereof with reference to the accompanying drawings, and in which.

DETAILED DESCRIPTION OF THE PREFERRED EMBODIMENTS

Figure 1:
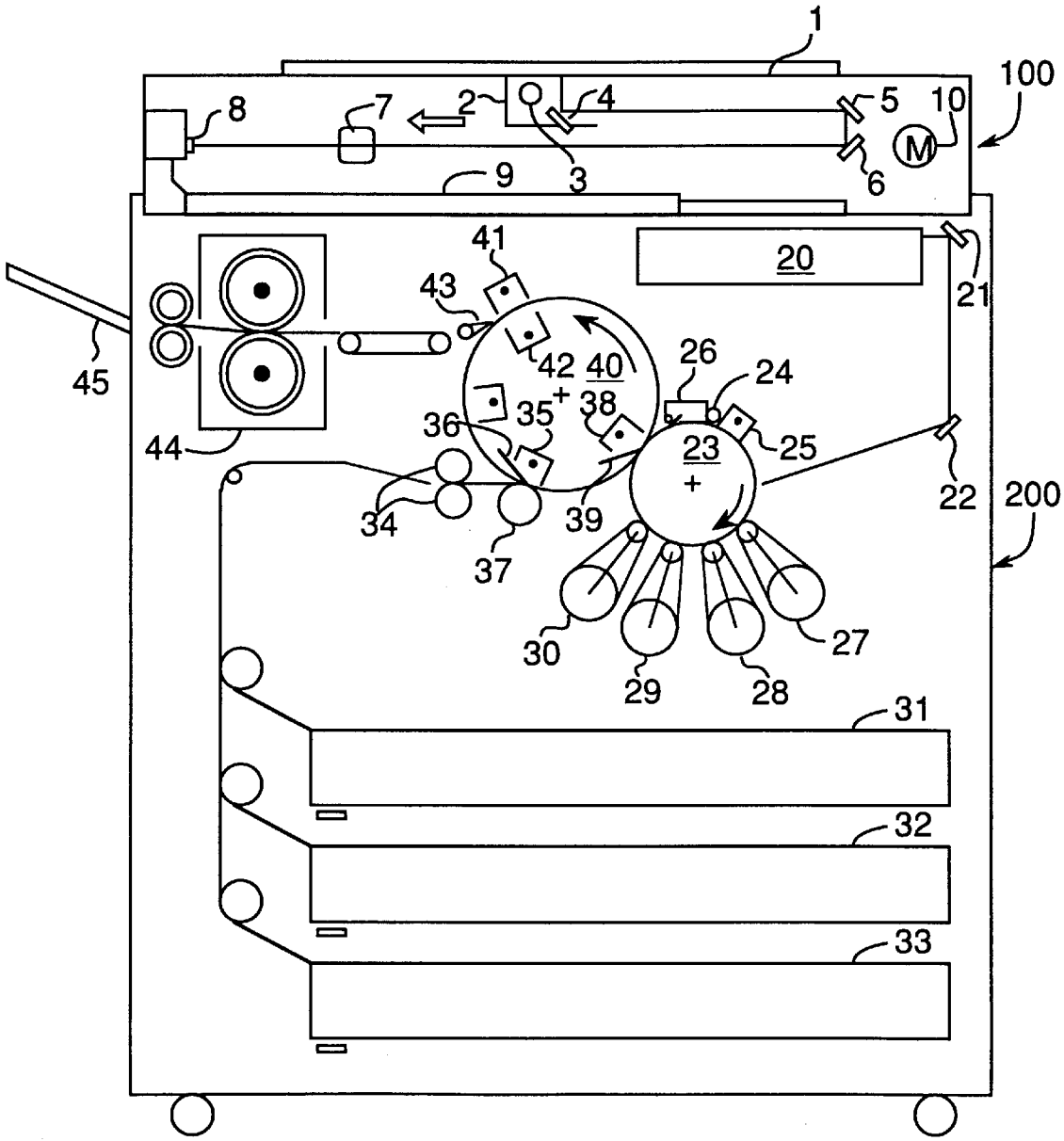
FIG. 1 is a schematic sectional view of a digital, full color copying machine of a first embodiment of the invention.

Referring now to the drawings, wherein like reference characters designate like or corresponding parts throughout the views, copying machines of several embodiments of the invention are explained.

FIG. 1 shows a digital, full color copying machine of a first embodiment of the invention. This copying machine mainly comprises an image reader 100 for reading an image of a document and a printer 200 for forming an image on a paper based on the image data read by the image reader 100.

In the image reader 100, a document put on a platen glass 1 is illuminated with a lamp 3 mounted to a scanner 2. A light reflected from the document propagates through mirrors 4, 5 and 6 and a focus lens 7 to be imaged onto a CCD (charge coupled device) line sensor 8. The scanner 2 moves in the direction of an arrow (vertical scan direction) at a speed of V corresponding to a magnification by a scanner motor 10, while the mirror 5 and 6 move in the same direction similarly at a speed of V/2 by the scanner 2. Thus, the document put on the platen glass 1 is scanned over a whole face. A signal processor 9 converts multi-level electric signals of red (R), green (G) and blue (B) obtained with the CCD line sensor 8 to 8-bit gradation data, which are output to the printer 200.

In the printer 200, a print head 20 receives the gradation data from the signal processor 9 and generates a drive signal according to the gradation data. A laser diode in the print head 200 emits a light beam according to the drive signal, and the laser beam scans a surface of a photoconductor drum 23 through mirrors 21 and 22. In every copy operation, the photoconductor drum 23 has been illuminated with an eraser lamp 24 and has been charged uniformly with a sensitizing charger 25 before the scan is started. An electrostatic latent image of a document is formed on the photoconductor drum 23 by the scan of the laser beam. A development unit 27 of cyan is first selected among development units 27–30 of cyan, magenta, yellow and black, to develop the electrostatic latent image on the photoconductor drum 23. A paper of a suitable size selected in paper cassettes 31–33 is fed to a pair of timing rollers 34. The timing rollers 34 carry the paper to a transfer drum 40 at a timing so that a top of a toner image developed on the photoconductor drum 23 agrees with a top of the paper. The paper is adsorbed electrostatically to the transfer drum 40 by an adsorption charger 35 and an adsorption roller 37. The toner image of cyan developed on the photoconductor dram 23 is transferred to the paper wound on the transfer drum 40 with the transfer charger 38. Toners remained on the photoconductor drum 23 after the transfer of the toner image is removed with a cleaner 26.

Next, the toner development units of magenta, yellow and black are sequentially selected, and the above-mentioned charging, exposure and toner development on the photoconductor drum 23 are repeated. The toner images of four colors developed on the photoconductor drum 23 is layered succesively on the paper wound on the transfer drum 40.

Then, the paper to which the toner images of four colors is transferred is separated from the transfer drum 40 by a claw 43 after the transfer drum 40 is discharged with a charger 41. The paper separated from the transfer drum 40 is fixed by a fixing unit 44 and is carried out onto a tray 45.

Figure 2:
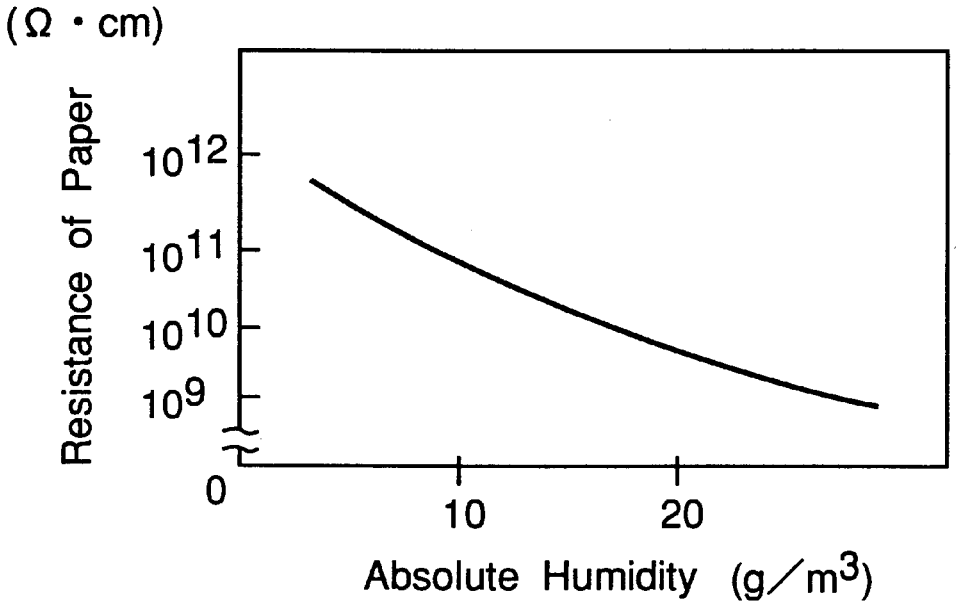
FIG. 2 is a graph of volume resistance (Ω·cm) of paper against absolute humidity ($g/m^3$)
Figure 3:
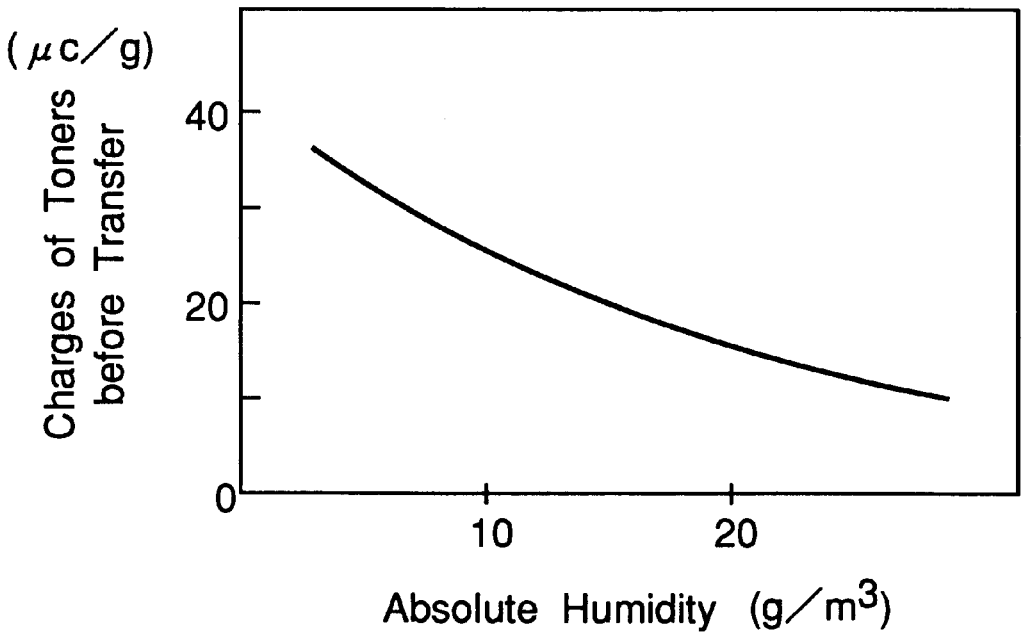
FIG. 3 is a graph where the amount ($\mu C/g$) of the charges of toners before transfer plotted against absolute humidity ($g/m^3$)

The resistance of paper and the amount of toner charges influence the transfer efficiency when a toner image on the photoconductor drum 23 is transferred onto the paper, as will be explained below. When a paper absorbs moisture or is dried in an ambient environment, the electric characteristic thereof is changed. FIG. 2 shows a relation of volume resistance (Ω·cm) of the paper to absolute humidity (g/m$^3$). This graph shows that the volume resistance decreases with increasing absolute humidity. Moreover, the amount of toner charges before the toner image is transferred also depends on humidity. FIG. 3 shows a relation of toner charges ($\mu$C/g) before transfer to absolute humidity (g/m$^3$). The graph shows that the amount of toner charges before transfer decreases with increasing absolute humidity.

Figure 4:
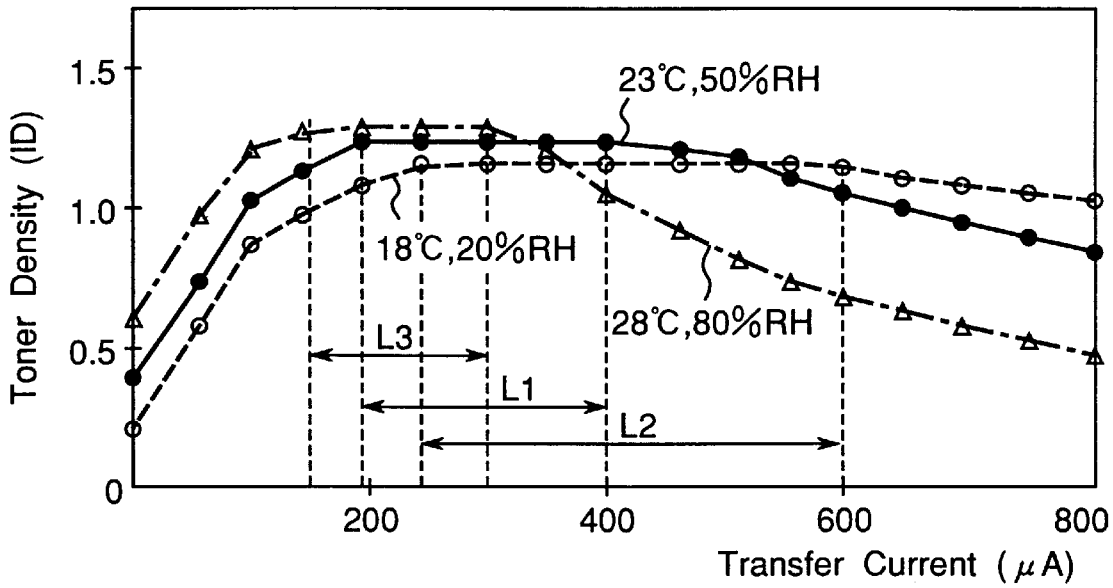
FIG. 4 is a graph of toner density plotted against transfer current after the apparatus is left for seven to eight hours to adapt it with the environment under three environments.

Next, the transition of toner density under various environment is explained. FIG. 4 illustrates examples of the transition of toner density plotted against transfer current after the apparatus is left for seven or eight hours to adapt it with the environment under three environments. A solid line represents a characteristic curve under the environment of 50% RH of humidity and 23° C. of temperature. When the transfer current is in a range denoted with L1, the transfer efficiency becomes the best and the toner density on the paper becomes the maximum. The toner density decreases gradually when the transfer current exceeds about 400 $\mu$A. A dashed line represents a characteristic curve under the environment of 20% RH of humidity and 18° C. of temperature. If this environment is compared with the case of 50% RH of humidity, a rate of increase in toner density with increasing transfer current is lower, and the value of transfer current where the transfer efficiency is the best or the toner density is the maximum becomes higher. The toner density on the paper becomes the maximum within a range denoted with L2 of the transfer current. The toner density decreases more gradually after the transfer current exceeds 550 $\mu$A if compared with the case of 50% RH of humidity. A dot and dashed line represents a characteristic curve under the environment of 80% RH of humidity and 28° C. of temperature. A rate of increase in toner density according to increase in transfer current becomes higher and the toner density increases more rapidly if compared with the case of 50% RH of humidity. The toner density becomes the maximum within a range denoted with L3 of 100–300 $\mu$A of the transfer current, and it decreases more rapidly when the transfer current exceeds 300 $\mu$A if compared with the case of 50% RH of humidity. As will be understood from the above-mentioned three curves, when humidity is high, the increase rate of toner density with increase in transfer current is high and the decrease rate after reaching the maximum density is also high. When humidity is low, the increase rate of toner density with increase in transfer current after reaching the maximum density is low, and the decrease rate after reaching the maximum density is low. Moreover, the range of transfer current where the transfer efficiency is the best and the toner density is the maximum is broader as the humidity is lower.

Next, an appropriate range of transfer current in high humidity is explained with reference to FIG. 4. As shown in FIG. 4, when humidity is as high as 80% RH for example, the range of the transfer current where the toner density on paper becomes the maximum becomes very narrower if compared with the case of low humidity of, for example, 20% RH. The reason is that when the transfer current is increased, the value of transfer current at which the toner density begins to decrease is smaller. As shown in FIG. 3, the decrease in toner density at the side of high transfer current is ascribed to toners remained on the photoconductor drum 23 not transferred onto the paper due to charging of reverse polarity of toners by the transfer current of the charger 38 because the amount of toner charges becomes lower in the environment of high humidity.

The charging of reverse polarity can be prevented by increasing the amount of toner charges to some degree. Further, as shown in FIG. 2, the resistance of paper decreases with increase in humidity. When this resistance is high enough, the transfer current is suppressed to low to prevent the reverse charging of toners.

Figure 5:
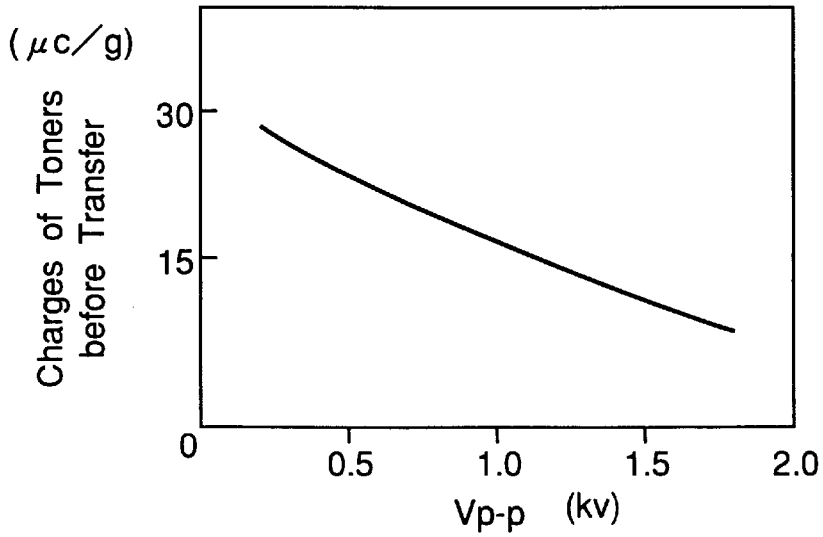
FIG. 5 is graph of toner charges before transfer plotted against peak-to-peak voltage $V_{p\text{-}p}$.
Figure 6:
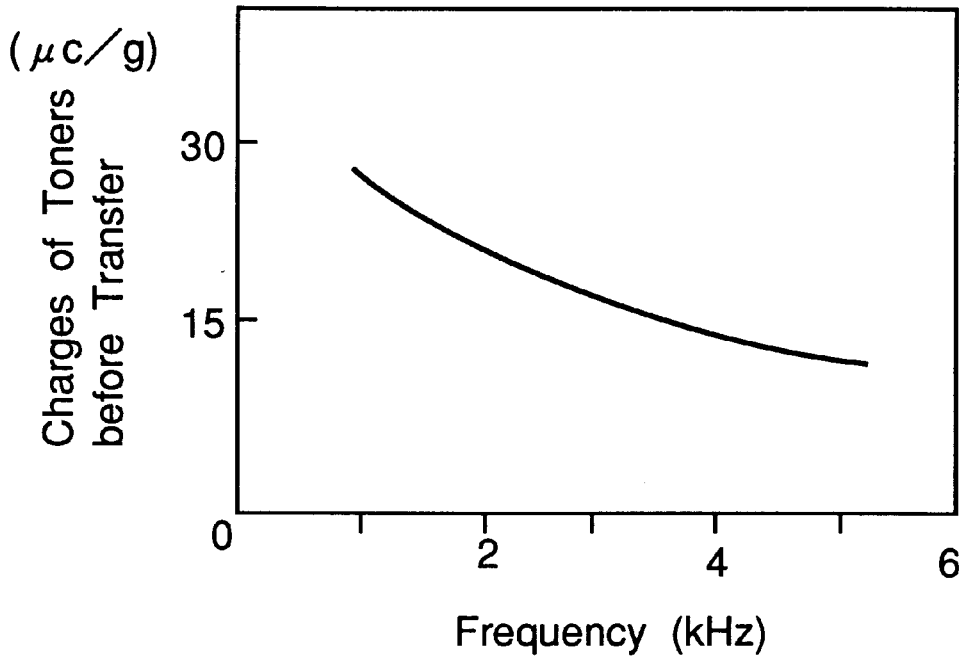
FIG. 6 is a graph of toner charges before transfer plotted against frequency.

Hereinafter, a relation of the development bias voltage is explained to the toner charges before transfer. The development bias voltage applied to the surface of the development sleeve when a latent image is developed with toners is not limited to a dc voltage, but it may be superposed with an alternating voltage. The alternating voltage superposed in this case is mainly a sine wave or a rectangular wave. The amount of the toner charges when toners are adhered onto the photoconductor drum 23 just before transfer depends largely on the value and the frequency of the superimposed alternating voltage. For example, if a sine wave is superposed to a dc voltage, FIG. 5 shows a change in the amount of toner charges before transfer when peak-to-peak voltage $V_{p\text{-}p}$ is changed, and FIG. 6 shows a change in the amount of the toner charges before transfer when frequency is changed. As shown in FIGS. 5 and 6, the amount of toner charges before transfer decreases with increase in voltage $V_{p\text{-}p}$ and decreases with increase in frequency f.

Figure 7:
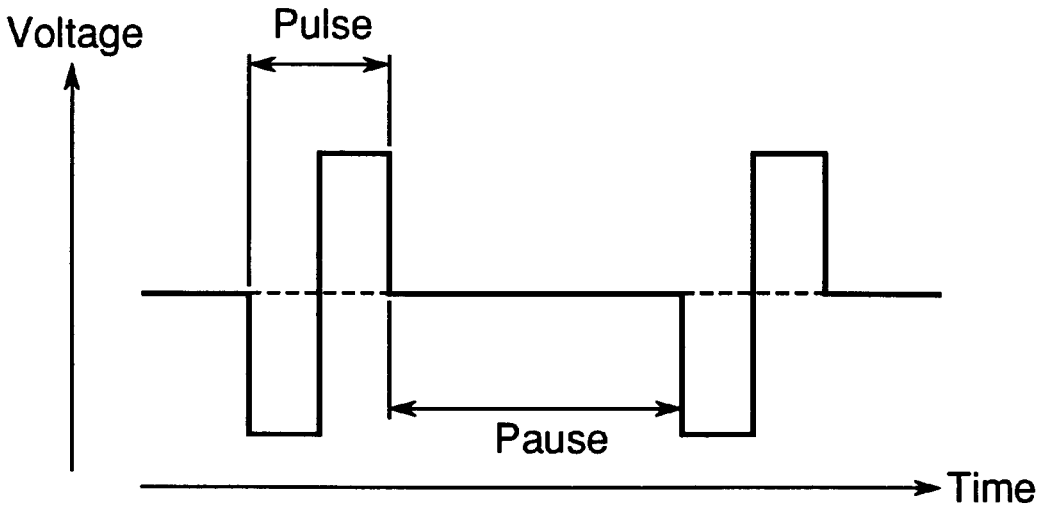
FIG. 7 is a graph of a pulse waveform having a pause period for development bias voltage.
Figure 8:
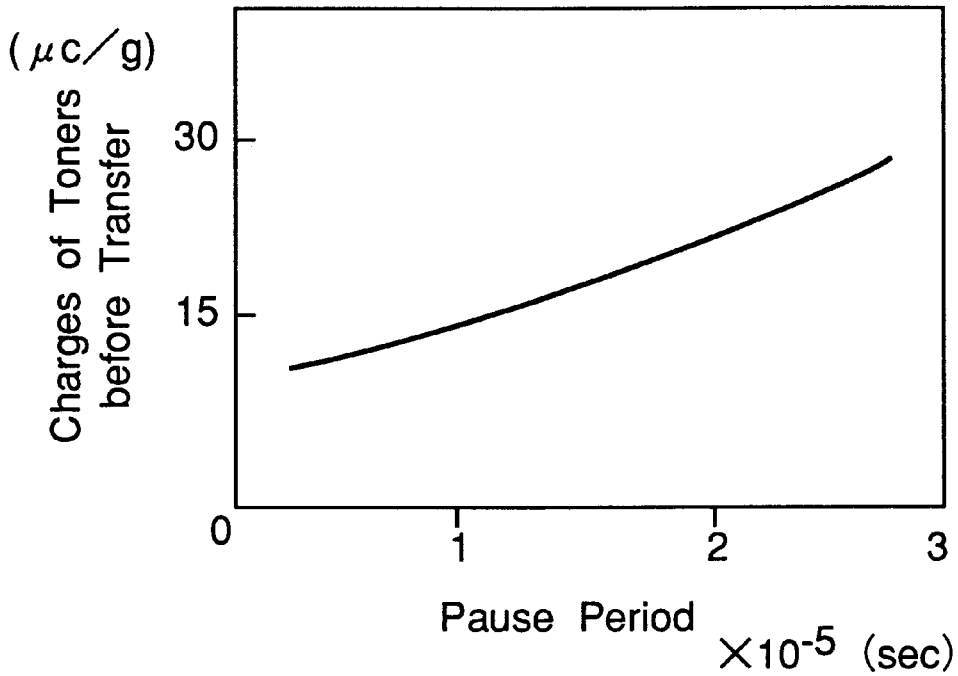
FIG. 8 is a graph of toner charges before transfer plotted against the time of a pause period.
Figure 9:
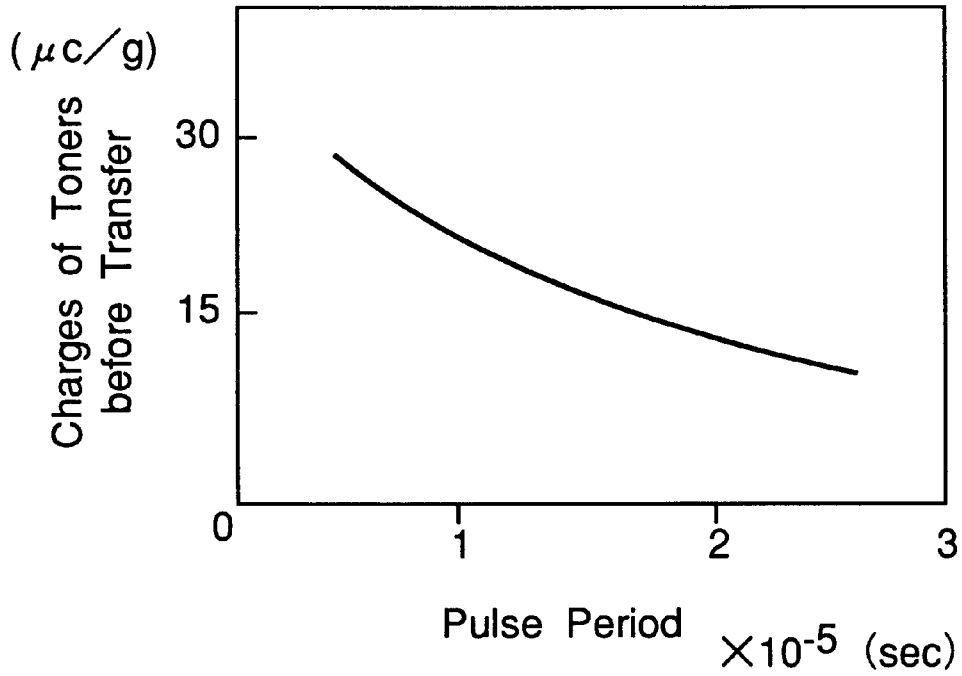
FIG. 9 is a graph of toner charges before the transfer plotted against the time of a pulse period.

Moreover, a pulse wave including a pause region, as shown in FIG. 7, can be used for the development bias voltage instead of a rectangular wave. When the pulse wave shown in FIG. 7 is used for the development bias voltage, FIG. 8 shows the amount of toner charges before transfer when the time of the pause region is changed, and FIG. 9 shows the amount of the toner charges before transfer when the time of the pulse period is changed. As shown in FIG. 8, the amount of the toner charges before transfer increases as the time of the stop part increases, while as shown in FIG. 9, it decreases as the time of the pulse period increases.

Figure 10:
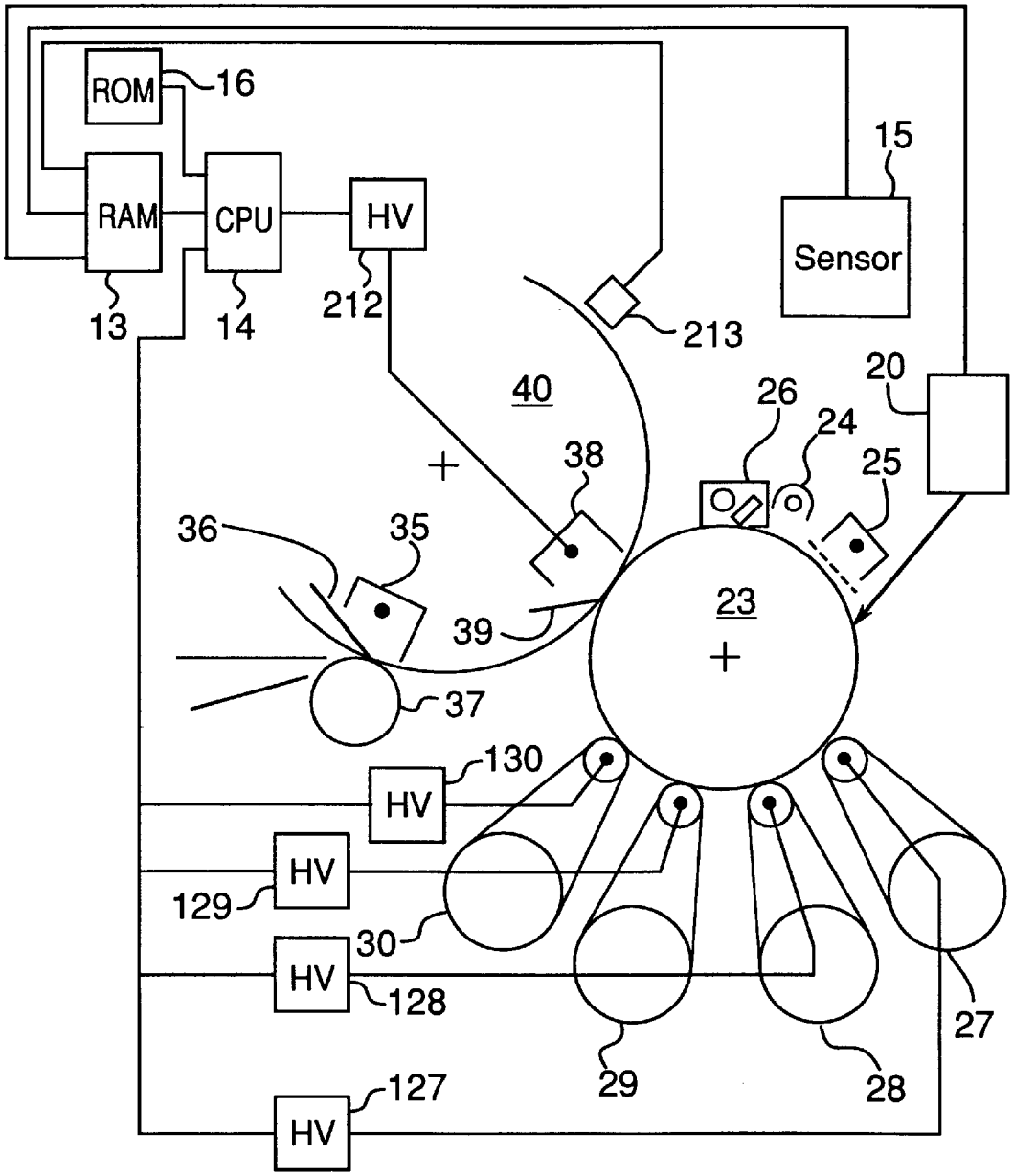
FIG. 10 is a schematic sectional view of a part around the photoconductor drum and the transfer drum of the digital, full color copying machine.

FIG. 10 shows the copying machine in detail near the photoconductor drum 23 and the transfer drum 40. The same reference numbers are used for the same parts as shown in FIG. 1, and duplicated explanation therefor is omitted. A central processing unit (CPU) 14 is connected to a read only memory (ROM) 16 storing a control program and a control table, a random access memory (RAM) 13 for storing a signal from an environment sensor 15, a toner density sensor 213 or the like, and high voltage sources (HV) 127–130 for supplying development bias voltages to the surface of development sleeve of the development units 27–30, and a high voltage source (HV) 212 for supplying a current to a charge wire in the transfer charger 38. (The current supplied to the charge wire is called as transfer current.) The voltage supplied by the high voltage sources 127–130 is a dc voltage superposed with a sine wave. As mentioned above, the current supplied to the charge wire by the high voltage source 212 is called as transfer current. In order to adapt the development characteristics to the environment and the like, the CPU 14 controls the value of the dc voltage component according to a detection amount of adhered toners on the photoconductor detected with a sensor (not shown). Moreover, the sine wave superposed to the dc voltage component is set at default peak-to-peak voltage $V_{p\text{-}p}$ of 2 kV and default frequency f of 4 Hz.

Before a copy operation is started or a copy mode is set, a plurality of toner patterns of the same density are formed on the photoconductor drum 23, and they are transferred onto a paper while changing the charge wire current: (or transfer current) stepwise generated by the high voltage source 212 to the transfer charger 38. Then, the toner density of each toner pattern transferred onto the paper is detected as the data on the transfer efficiency for each transfer current, and the peak-to-peak voltage $V_{p\text{-}p}$ of the sine wave of the development bias voltage as a development condition is controlled according to the detected value. In a copy operation performed after the control of the development condition, the absolute humidity of the printer 200 is detected with the environment sensor 15. Then, when a toner image on the photoconductor drum 23 is transferred Onto a paper wound on the transfer drum 40, the transfer current is changed according to the absolute humidity in order to keep the transfer efficiency constant.

Table 1 shows a control table which specifies the transfer current corresponding to the absolute humidity detected with the environmental sensor 15. This control table is used when a full color image is formed, and it is stored in the ROM 16 with other various control data. As shown in Table 1, the transfer current is set based on the experiment data so that it increases with decrease in absolute humidity. The transfer current in each humidity section is set so that the value for a second color (magenta) is larger than that for a first color (cyan) and that the value for a third color (yellow) is larger than that for the second color, and that the value for a fourth color (black) is larger than that for the third color. This takes into account the influence of the charge-up of the transfer film by the transfer current for a previous color.

TABLE 1

Transfer current for absolute humidity

| | Transfer current (μA) | | | |
|---|---|---|---|---|
| Absolute humidity ($g/m^{3)}$ | First color (cyan) | Second color (magenta) | Third color (yellow) | Fourth color (black) |
| 0–5 | 550 | 600 | 650 | 700 |
| 6–10 | 500 | 550 | 600 | 650 |
| 11–15 | 450 | 500 | 550 | 600 |
| 16–20 | 400 | 450 | 500 | 550 |
| 21–25 | 350 | 400 | 450 | 500 |
| 26–30 | 300 | 350 | 400 | 450 |

Figure 11:
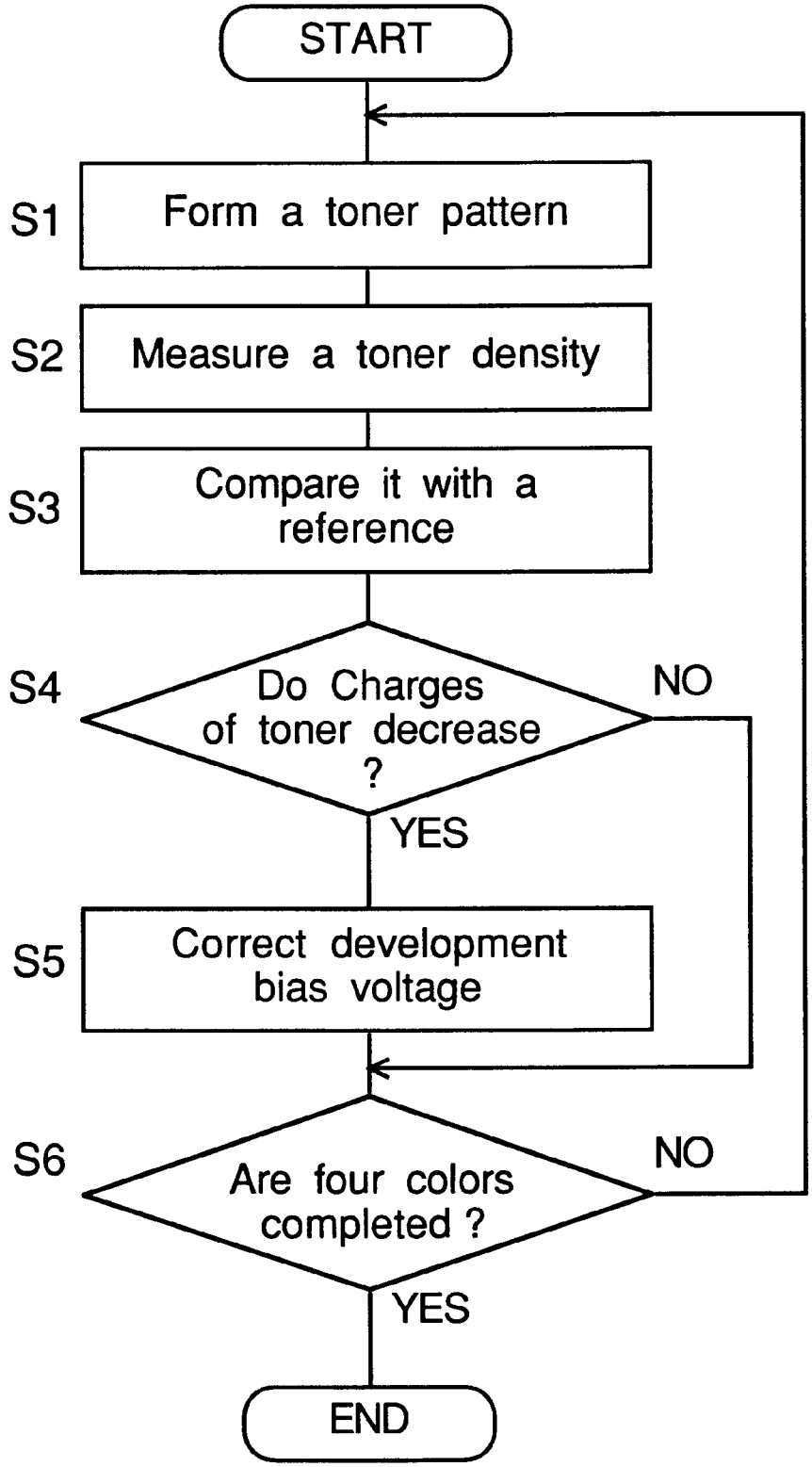
FIG. 11 is a flowchart of a control processing.
Figure 12:
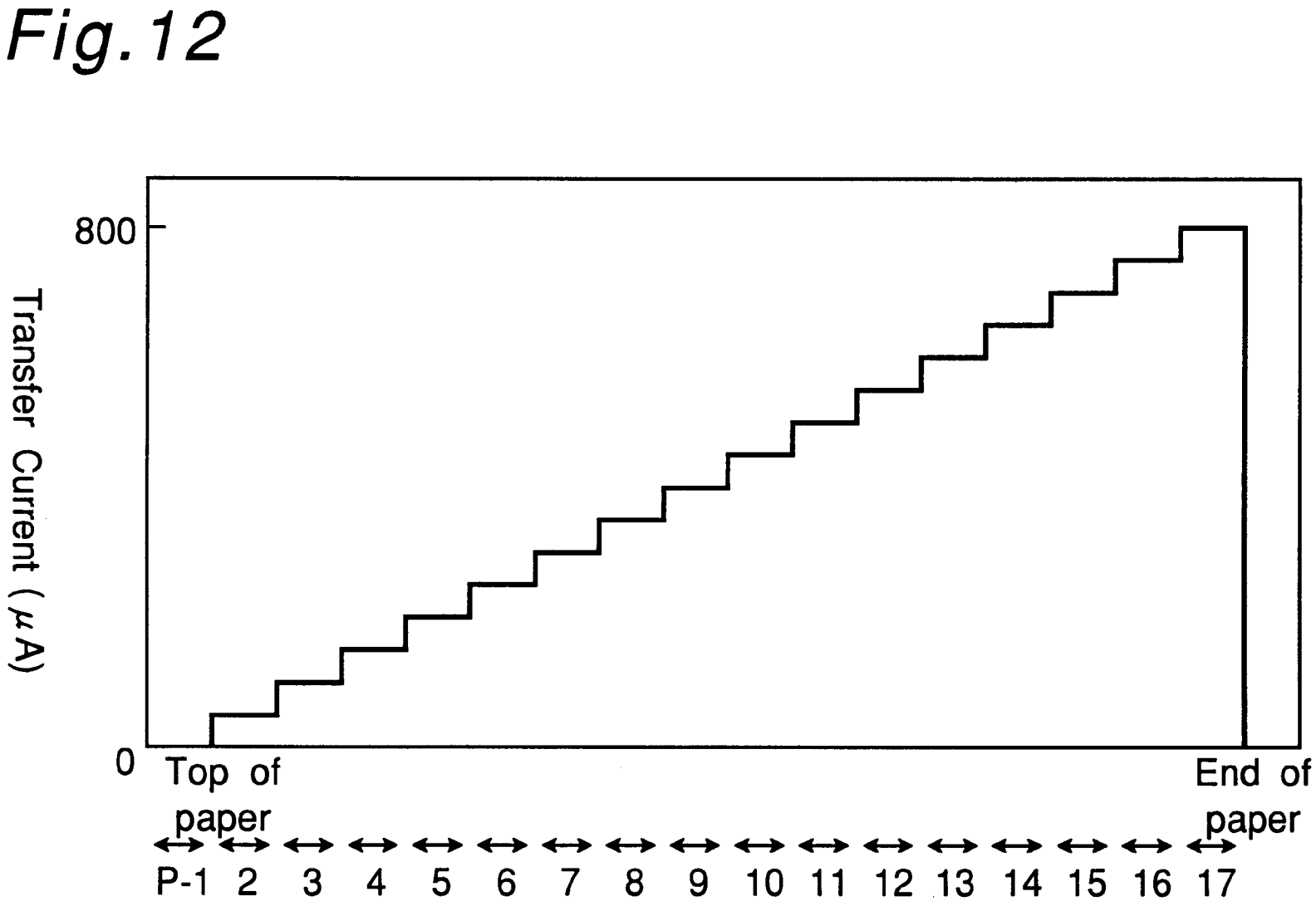
FIG. 12 is a graph of the transfer current supplied for the transfer of a toner pattern.
Figure 13:
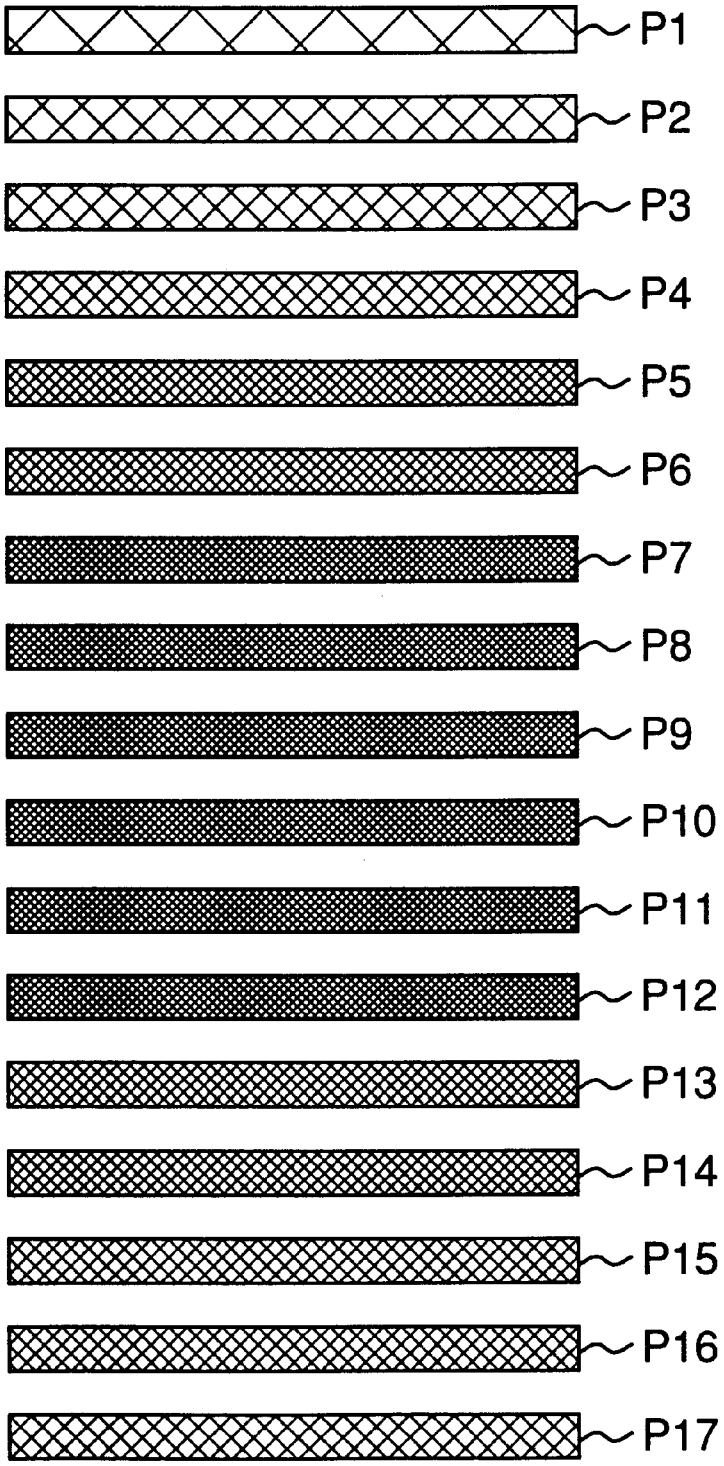
FIG. 13 is a diagram of toner patterns P1 to P17 formed on a paper.

FIG. 11 shows a flowchart of the control processing executed by the CPU 14 when a copy operation is started or a copy mode is set. First, a plurality of toner patterns are formed on a paper according to the following procedure (step S1). First, the print head 20 emits a light beam at regular intervals in a constant quantity of light, and latent image patterns P1 to P17 of seventeen lines are formed on the photoconductor drum 23. The latent image patterns P1 to P17 are developed as visible images with the development unit 27 for cyan in the same condition. The developed toner patterns P1 to P17 are transferred onto the paper wound around the transfer drum 40. When the toner patterns are transferred, the transfer current is increased from 0 to 800 μA from the top to the end of the paper. As a result, toner patterns P1 to P17 shown in FIG. 13 are transferred on the paper as shown in FIG. 12 like a stair having 17 steps.

Figure 14:
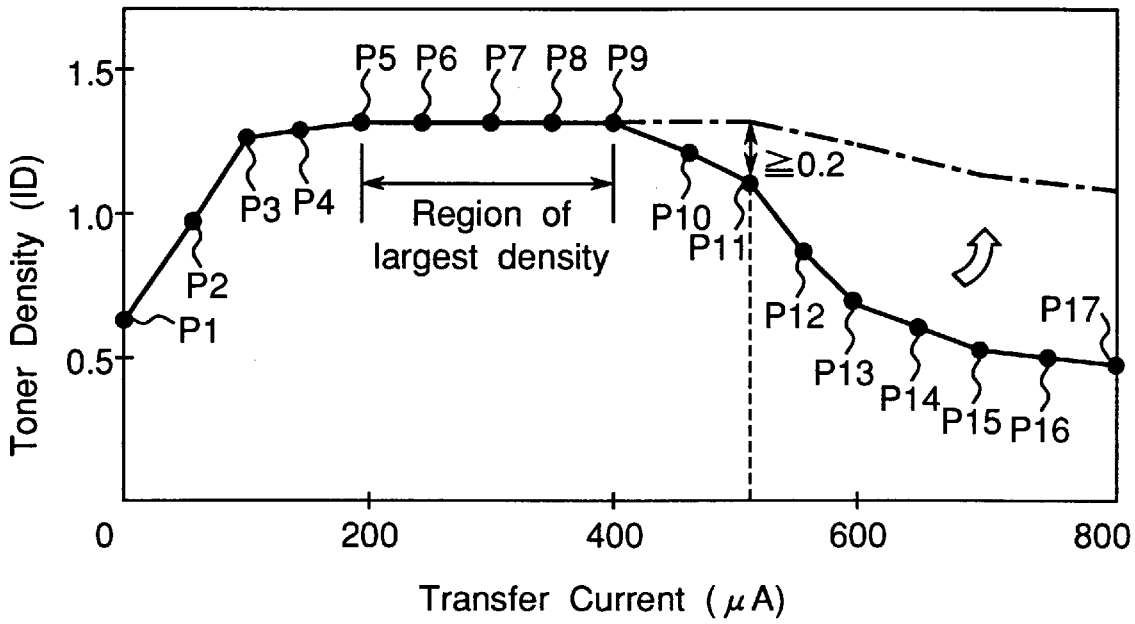
FIG. 14 is a graph of toner density formed on a paper plotted against transfer current.

Next, toner densities of the toner patterns P1 to P17 transferred onto the paper are measured with the toner density sensor 213, and the measured data are stored in the RAM 13 (step S2). Then, each actual density of the toner patterns P1–P17 written to the RAM 13 is compared with the counterpart toner density which should be realized for the toner pattern for the transfer current selected according to Table 1 (step S3). FIG. 14 shows an example of measured densities of the toner patterns P1 to P17. In FIG. 14, a dot and dashed line represents toner density which should be realized for the toner patterns for the transfer current selected according to Table 1. If the transfer current is higher than those for the maximum density, or if the measured density deviates towards a higher value for example by 0.2, it is decided that the amount of toner charges becomes low (YES at step S4). In FIG. 14, the transfer current denoted with a dashed line shows a case where the deviation is equal to or larger than 0.2. Then, the development bias voltage is controlled by the high voltage source 127–130 so that the peak-to-peak voltage $V_{p\text{-}p}$ of the sine wave of the development bias voltage set at 2.0 kV is changed to 1.5 kV (step S5). Thus, the amount of toner charges before transfer is increased, and the amount of remained toners on the photoconductor drum 23 due to reverse charging becomes smaller, and as represented with the dashed and dot line, the toner density at the higher transfer currents is enhanced. When it is decided that the processing is not complete for the four colors (NO at step S6), the flow returns to step S1, and a series of control processes of steps S1 to S5 is repeated for the remaining colors. The flow ends after the processing for four colors is decided to be complete (YES at step S6).

Many variations are used for the first embodiment as explained below, and they also hold for copying machines of second to sixth embodiments explained below. For example, in the above-mentioned method for forming the toner patterns, four sheets of paper are used. However, the toner patterns by the four development units may be formed in a sheet of paper by narrowing the width of each toner pattern and the interval between them. In a different way, the toner patterns may be formed by only one of the development units as a representative without repeating the detection on the four units, because the characteristics of the development material in the development units are about the same among the four units. Then, the development bias voltage supplied to each development unit is based on the detected densities of toner patterns.

Moreover, as another means for measuring the density transferred on paper, instead of the sensor 213, a print image discharged to the tray 45 is put on the platen glass 1, and the image of the toner patterns is read with the CCD line sensor 8. Then, the development bias voltage is controlled based on the density read with the CCD line sensor 8.

The frequency of the transfer current can be controlled instead of $V_{p\text{-}p}$. As shown in FIG. 6, the control of the frequency has a similar advantage as that of $V_{p\text{-}p}$.

Further, as shown in FIG. 7, a pulse wave having a pause period may be used as the development bias voltage, and the time of the pause period or of the pulse period of the pulse wave may be controlled. That is, as shown in FIG. 8 where the relation of the amount of the toner charges before transfer is shown against the time of the pause period, the time of the pause period can be lengthened in order to increase the amount of toner charges. As shown in FIG. 9 where the relation of the amount of the toner charges before transfer is shown against the time of the pulse period, the time of the pulse period can be shortened in order to increase the amount of toner charges.

In the above-mentioned copying machine, the transfer charger 38 is used for transfer of toner images. However, a transfer brush or a transfer roller can also be used instead of the transfer charger 38. Moreover, a transfer belt can be used instead of the transfer drum 40.

Next, a copying machine of a second embodiment is explained. In the copying machine, when a copy operation is started or a copy mode is set, toner patterns of the same density are formed on the photoconductor drum 23, and they are transferred onto a paper by changing the transfer current. for each toner pattern. Then, the toner densities of the toner patterns are detected to represent the transfer efficiency on the paper for each transfer current, as in the first embodiment. Further, other characteristics such as the resistance of the paper and the amount of toner charges before transfer are also detected. The development conditions and the transfer conditions are controlled according to these detected values.

Figure 15:
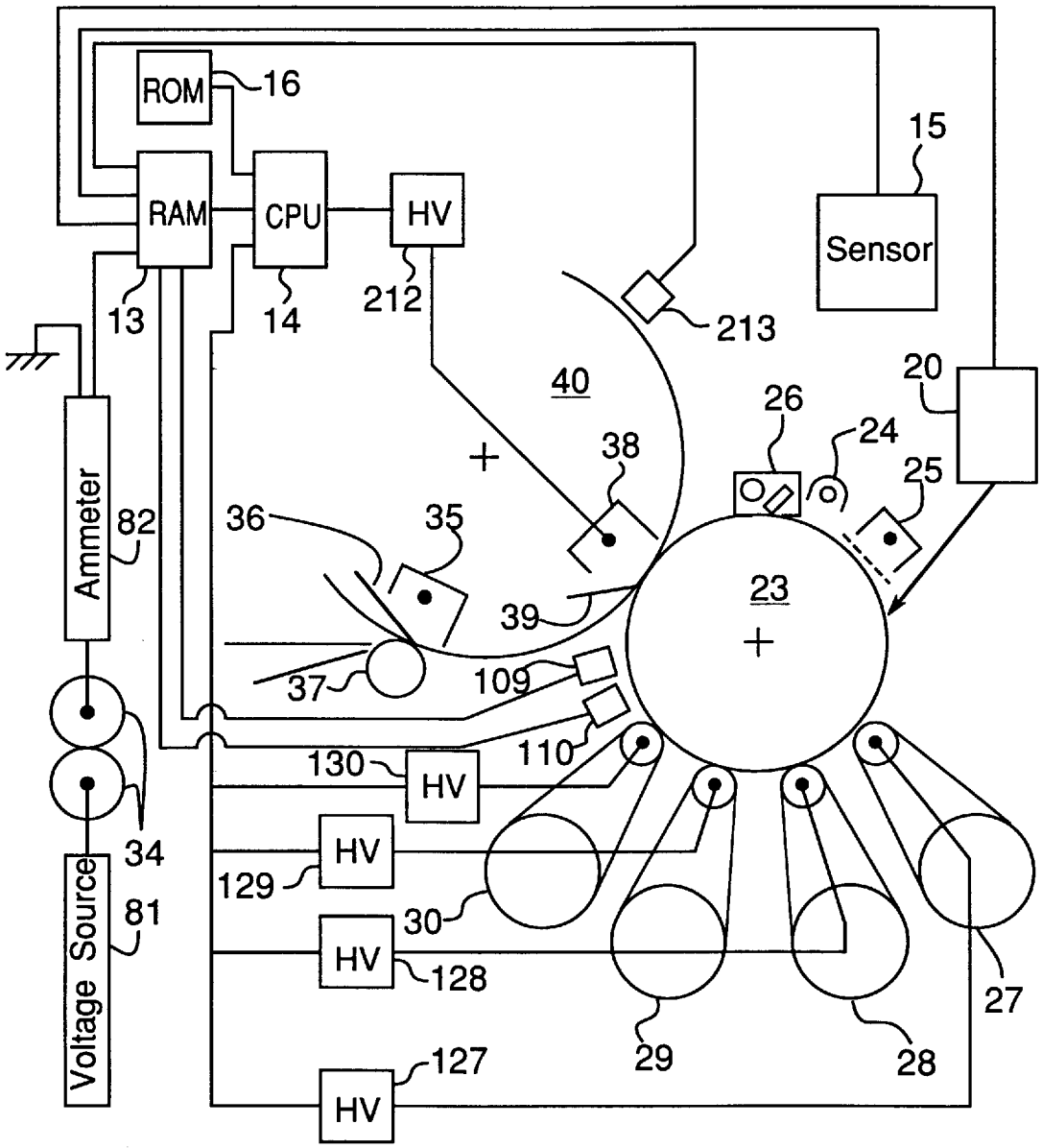
FIG. 15 is a schematic sectional view of a part around the photoconductor drum and the transfer drum of a digital, full color copying machine of a second embodiment.

FIG. 15 shows the copying machine in detail near the photoconductor drum 23 and the transfer drum 40 in the second embodiment. The same reference numbers are used for the same parts as FIG. 1, and duplicated explanation therefor is omitted. This copying machine comprises a voltage source 81 provided to apply a voltage to the timing rollers 34 and an ammeter 82 for measuring a current to determine the resistance of the paper. Further, besides the sensor 213 for detecting the toner density, a sensor 109 for measuring the amount of adhered toners just before transfer and a sensor 110 for measuring the surface potential of the photoconductor drum 23 just before transfer are provided around the photoconductor drum 23. While a paper passes between the timing rollers 34, the voltage source 81 applies a predetermined voltage to one of the timing rollers 34, the ammeter 82 measures the current flowing through the paper, and the resistance of the paper is calculated based on the applied voltage and the measured current. The measured value is sent to the RAM 13 and the CPU 14 through the RAM 13.

Figure 16:
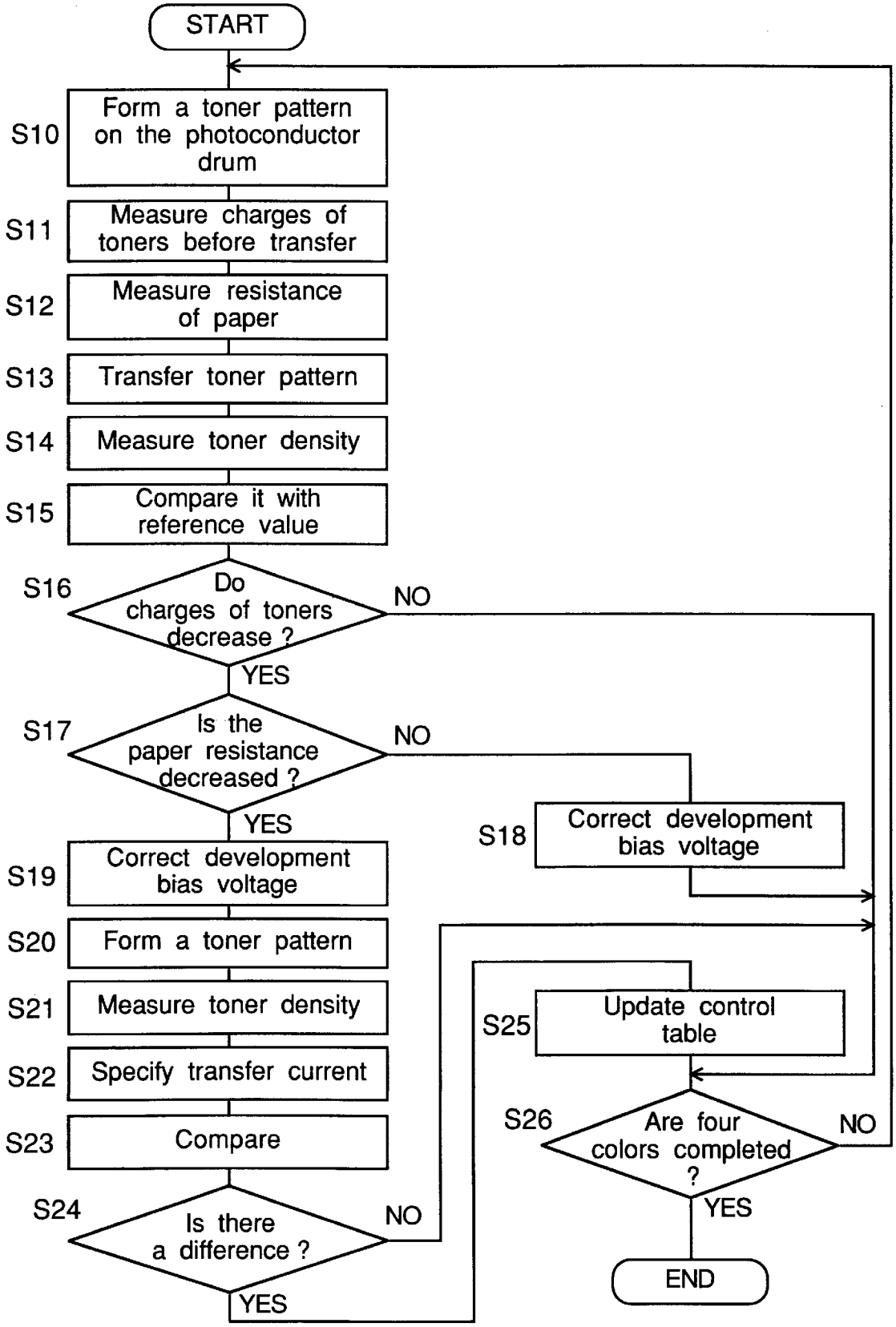
FIG. 16 is a flowchart of the control processing in the second embodiment.

FIG. 16 shows a flow of the control processing of the CPU 14 when a copy operation is started or a copy mode is set. First, a plurality of toner patterns are formed on the photoconductor drum 23 (step S10). The toner patterns are formed according to the following procedure. First, the print head 20 emits a light beam at regular intervals in a constant quantity of light, and latent image patterns P1 to P17 of seventeen lines are formed on the photoconductor drum 23. The latent image patterns P1 to P17 are developed as visible images with the development unit 27 for cyan in the same condition. Next, the amount of toner charges per weight is determined based on the amount of adhered toners measured with the sensor 109 and the potential of the toner patterns measured with the potential sensor 110 (step S11). In a different way, the development current flowing through the development sleeve is measured on development, and the amount of toner charges per weight is determined based on the measured development current and the amount of adhered toners measured with the sensor 109. Next, the resistance is measured with the ammeter 82 on the paper carried to the timing rollers 34 (step S12). Next, the toner patterns formed on the photoconductor drum 23 are transferred onto the paper wound on the transfer drum 40 (step S13). Next, the toner densities of the toner patterns P1 to P17 transferred on the paper are measured with the toner density sensor 213, and the measurement data are stored in the RAM 13 (step S14).

Next, each of the actual densities of each toner pattern P1–P17 written to the RAM 13 is compared with the counterpart of toner density which should be realized for the toner pattern for the transfer current selected according to Table 1 (step S15). Then, if the measured density deviates towards a higher value for example by 0.2, it is decided that the amount of toner charges becomes low (YES at step S16) In such a case, the amount of toner charges is equal to or smaller than 10 $\mu$C/g and the amount of toner charges is not appropriate. Then, it is decided next whether the resistance of the paper is smaller than a predetermined value, for example, $10^9\Omega\cdot$cm (step S17). If the resistance of the paper is not smaller than the predetermined value (NO at step S17), only the amount of toner charges is not appropriate. Then, the high voltage sources 127–130 are controlled so that the peak-to-peak voltage $V_{p\text{-}p}$ of the sine wave of the development bias voltage is changed from the default value of 2.0 kV to 1.5 kV (step S18). Thus, the amount of charged toners just before transfer becomes larger and the amount of toners remained on the photoconductor drum 23 due to reverse charging become smaller, so that the toner density on the transfer material is increased to a desired level such as a dashed and dot line shown in FIG. 14.

On the other hand, if the resistance of the paper is decided to be smaller than the predetermined value (YES at step S17), the amount of toner charges becomes low, and the resistance of the paper becomes low. Then, the high voltage sources 127–130 are controlled so that the peak-to-peak voltage $V_{p\text{-}p}$ of the sine wave of the development bias voltage is changed from the default value of 2.0 kV to 1.5 kV (step S19). However, this correction may not be sufficient for the appropriate transfer efficiency when the resistance of the paper is low. Then, toner patterns are formed again on the paper (step S20), and the toner densities thereof are measured (step S21). Next, the transfer current of the toner pattern having the largest toner density is determined (step S22), and the determined density is compared with the value of the transfer current in Table 1 in correspondence to the absolute humidity detected by the environment sensor 15 (step S23) If a difference is detected (YES at step S24), the control table is updated so that the transfer current determined at step S22 is selected for the absolute humidity detected by the environment sensor 15, and the updated control table is written to the RAM 13 (step S25). The CPU 14 controls the transfer current by using the control table written to the RAM 13 until the control table is updated next.

Next, if it is decided that the processing is not complete for the four colors (NO at step S26), the flow returns to step S10, and a series of control processes of steps S10 to S25 is repeated for the remaining colors. The flow ends after the processing for four colors is completed (YES at step S26).

In the above-mentioned embodiment, the amount of toner charges and the resistance of the paper are used to decide whether the decrease in transfer efficiency is caused by deterioration of toners or by decrease in the resistance of paper. However, only one of the amount of toner charges and the resistance of the paper may be detected besides the transfer efficiencies of the toner patterns, and the transfer efficiency and the transfer conditions are controlled according to the detected value of the one of them. For example, only the transfer condition is controlled if the transfer efficiencies and the resistance of the paper are smaller than respective reference values. In this case, the decrease in transfer efficiency is ascribed to decrease in the resistance of paper under high humidity environment. On the other hand, only the development condition is controlled if the transfer efficiencies and the amount of toner charges before transfer are smaller than respective reference values. In this case, the decrease in transfer efficiency is ascribed to deterioration of toners.

Next, a third embodiment of the copying machine of the invention is explained. In the copying machine, when a copy operation is started or a copy mode is set, toner patterns of the same density are formed on the photoconductor drum 23, and they are transferred onto a paper by changing the transfer current for each toner pattern. Then, the toner densities of toner patterns remained on the photoconductor drum 23 are detected to represent the transfer efficiency for each transfer current. Then, the peak-to-peak voltage $V_{p\text{-}p}$ of the sine wave of the development bias voltage as a development condition is controlled according to the detected value.

Figure 17:
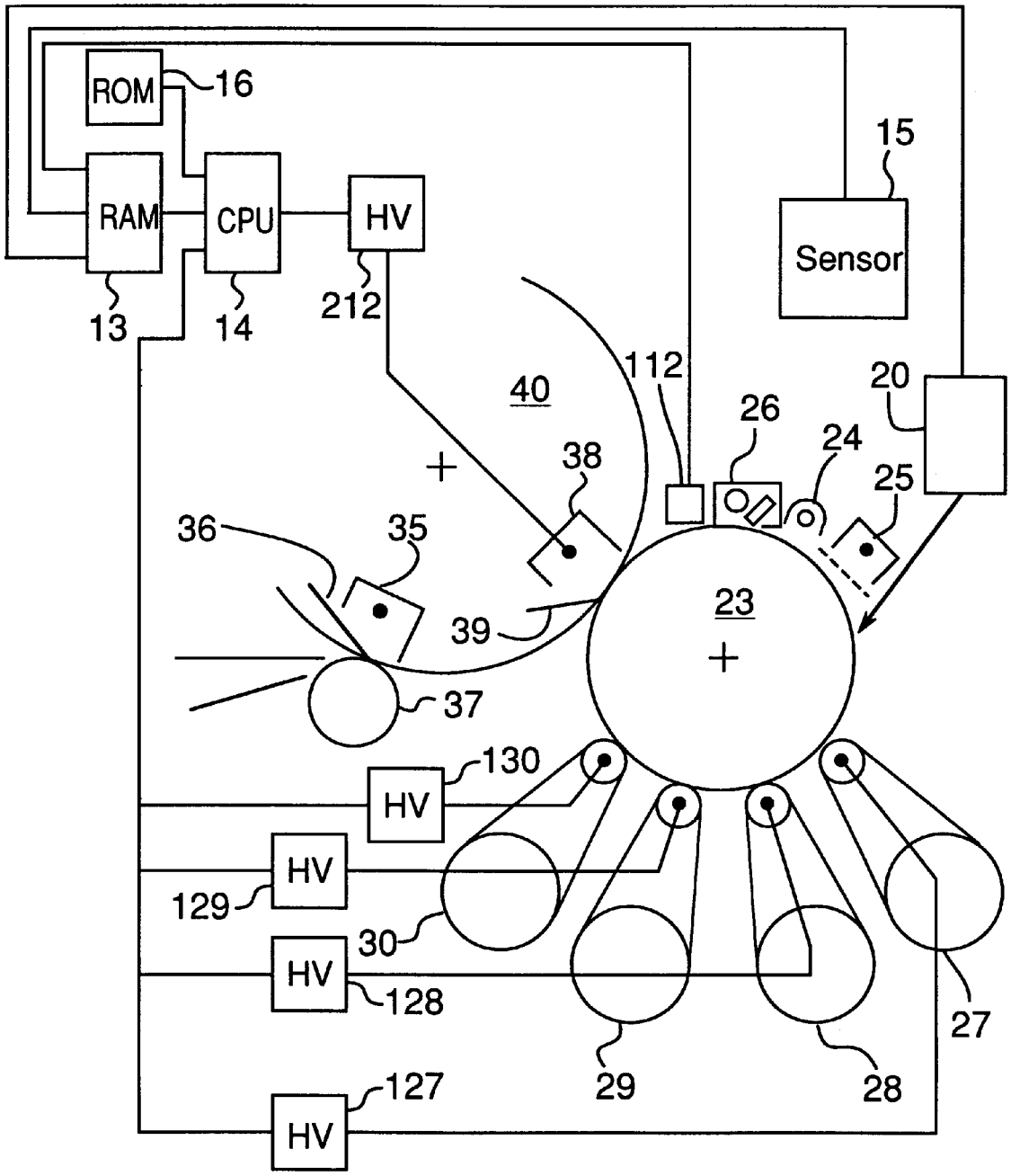
FIG. 17 is a schematic sectional view of a part around the photoconductor drum and the transfer drum of a digital, full color copying machine of a third embodiment.

FIG. 17 shows the copying machine in detail near the photoconductor drum 23 and the transfer drum 40 in the third embodiment. The same reference numbers are used for the same parts as FIG. 1, and duplicated explanation therefor is omitted. This copying machine is different from that shown in FIG. 10 in that a sensor 112 for detecting the density of toners remained on the photoconductor drum 23 is provided at the downstream side relative to the transfer point, instead of the sensor 213 for detecting toner density on a paper.

Figure 18:
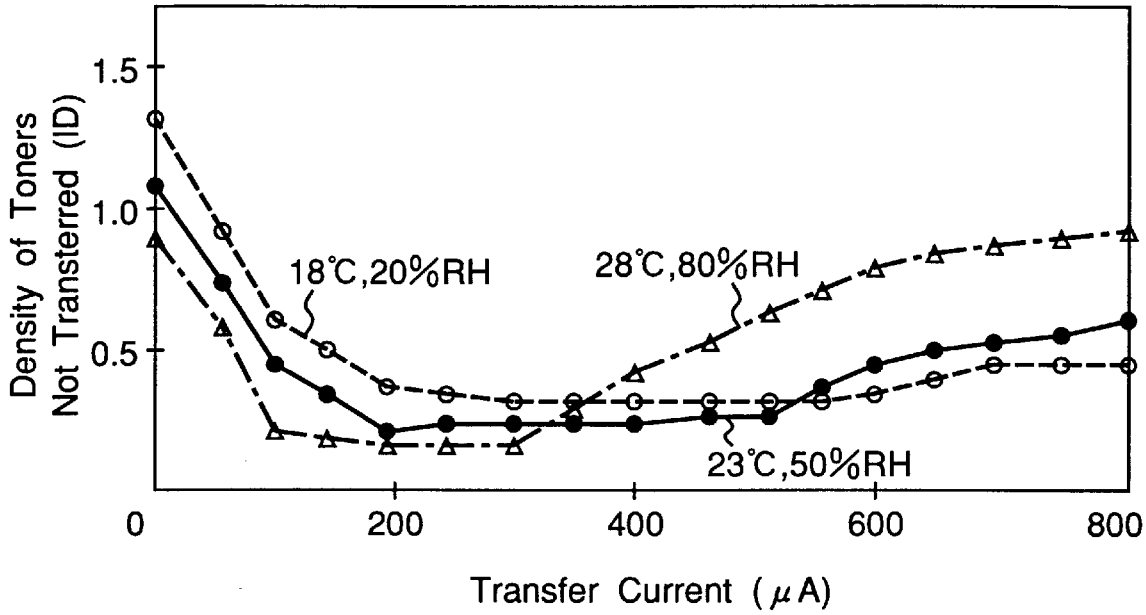
FIG. 18 is a graph of the density of remained toners plotted against transfer current after the apparatus is left for seven or eight hours to adapt it with the environment under three environments.

FIG. 18 shows transition of the density of remained toners when the transfer current is changed after the apparatus is left for 7–8 hours under three environments to adapt it with the environment. A solid line represents a characteristic curve under the environment of 50% RH of humidity at 23° C. of temperature, a dashed line represents a characteristic curve under the environment of 20% RH of humidity at 18° C. of temperature, and a dashed and dot line represents a characteristic curve under the environment of 80% RH of humidity at 28° C. of temperature. As will be understood from the above-mentioned three curves, when humidity is high, the decrease rate of the density of remained toners with increase in transfer current is high and the increase rate after reaching the maximum density is also high. When humidity is low, the decrease rate of the density of remained toners with increase in transfer current after reaching the maximum density is low, and the increase rate after reaching the maximum density is low. Moreover, the range of transfer current where the transfer efficiency is the best and the density of remained toners is the minimum is broader as the humidity is lower.

Figure 19:
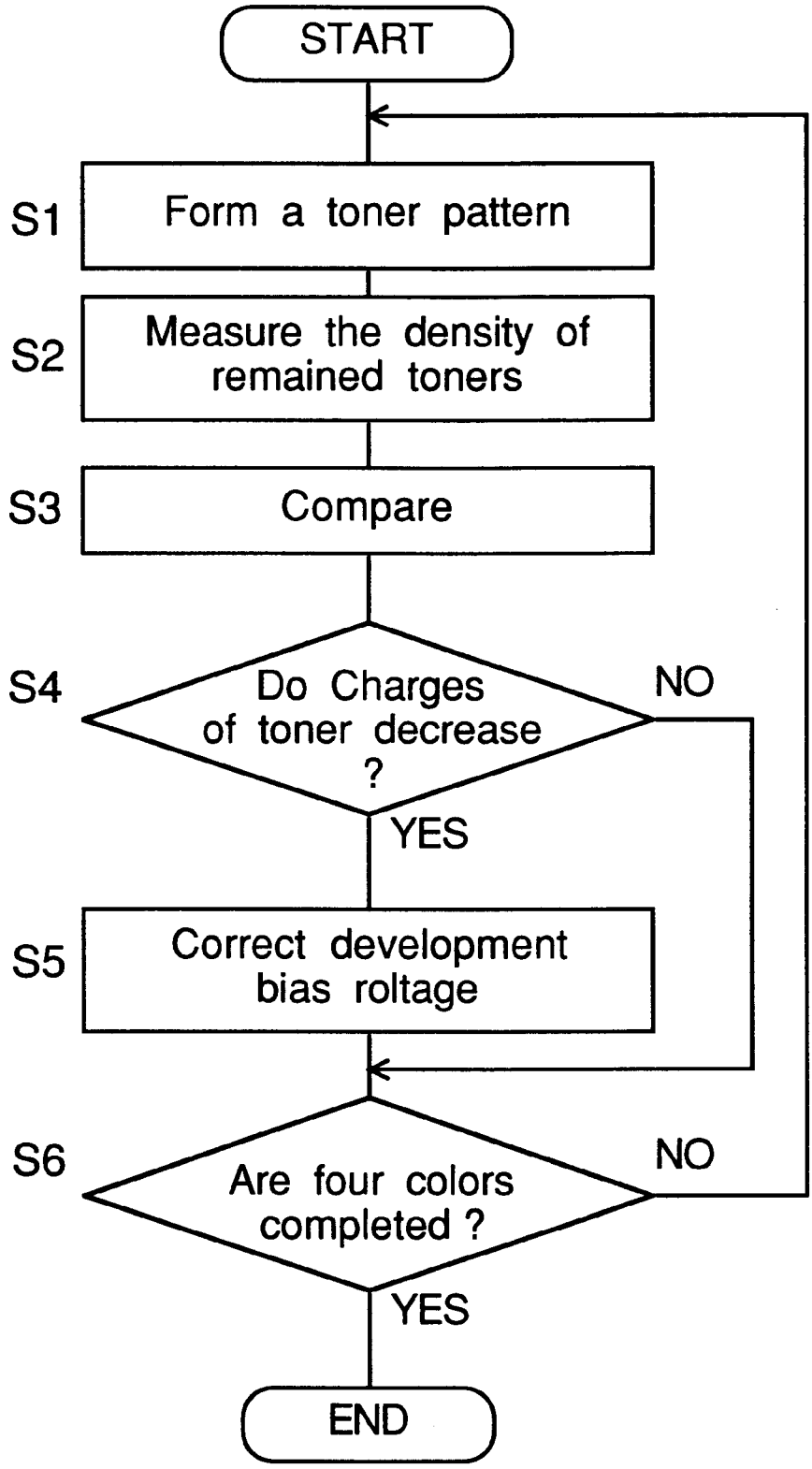
FIG. 19 is a flowchart of the control processing in the third embodiment.

FIG. 19 shows a flowchart of the control processing executed by the CPU 14 when a copy operation is started or a copy mode is set. First, a plurality of toner patterns are formed (step S30). The toner patterns are formed according to the following procedure. First, the print head 20 emits a light beam at regular intervals in a constant quantity of light, and latent image patterns P1 to P17 of seventeen lines are formed on the photoconductor drum 23. The latent image patterns P1 to P17 are developed as visible images with the development unit 27 for cyan in the same condition. The developed toner patterns P1 to P17 are transferred by the paper wound around the transfer drum 40. While the toner patterns are transferred, the transfer current is increased from 0 to 800 $\mu$A from an edge to the other edge of the paper as shown in FIG. 12 like a stair at 17 steps. As a result, toner patterns P1 to P17 shown in FIG. 13 are transferred on the paper.

Figure 20:
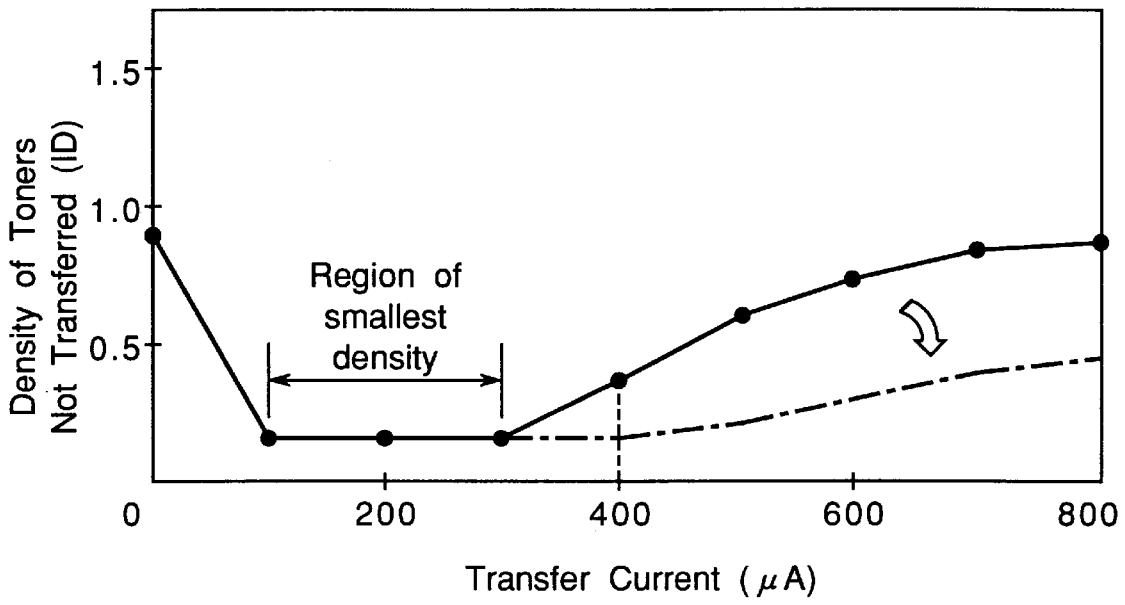
FIG. 20 is a graph of toner density remained on the photoconductor drum plotted against the transfer current.

Next, the toner densities of toner patterns remained on the photoconductor drum 23 are measured with the toner density sensor 112, and the measured data are stored in the RAM 13 (step S31), and the detected densities of each toner pattern P1–P17 are compared with the counterparts of toner densities which should be realized for the toner patterns for the transfer current selected according to a control table (step S32). FIG. 20 shows an example of measured toner densities of toner patterns P1 to P17 remained on the photoconductor drum 23 for each transfer current after transfer onto a paper. In FIG. 20, a dot and dashed line represents densities of remained toners of toner pattern P1 to P17 which should be realized for the toner patterns for the transfer current selected according to the control table. As shown in FIG. 20, when the toner density detected is higher than that for the maximum density, if the measured density deviates towards a higher value for example by 0.2, it is decided that the amount of toner charges becomes low due to deterioration of endurance (YES at step S33). Then, the development bias voltage is controlled by the high voltage source 127–130 so that the peak-to-peak voltage $V_{p\text{-}p}$ of the sine wave of the development bias voltage set at 2.0 kV becomes 1.5 kV (step S34). Thus, the amount of toner charges before transfer is increased, and the amount of remained toners on the photoconductor drum 23 due to reverse charging becomes smaller, and as represented with the dashed and dot line in FIG. 20, the remained toner density at the higher transfer currents is suppressed below a predetermined level. When the processing is decided not to be complete for the four colors (NO at step S35), the flow returns to step S1, and a series of control processes of steps S30 to S34 is repeated for the remaining colors. The flow ends when it is decided that the processing for four colors is complete (YES at step S36).

Next, a fourth embodiment of the copying machine of the invention is explained. In the copying machine, when a copy operation is started or a copy mode is set, toner patterns of the same density are formed on the photoconductor drum 23, and they are transferred onto a paper by changing the transfer current for each toner pattern. Then, the toner densities of toner patterns remained on the photoconductor drum 23 are detected to represent the transfer efficiency for each transfer current. Further, the resistance of a paper and the amount of toner charges before transfer are detected as characteristic quantities. Then, the development condition and the transfer condition are controlled according to the detected values.

Figure 21:
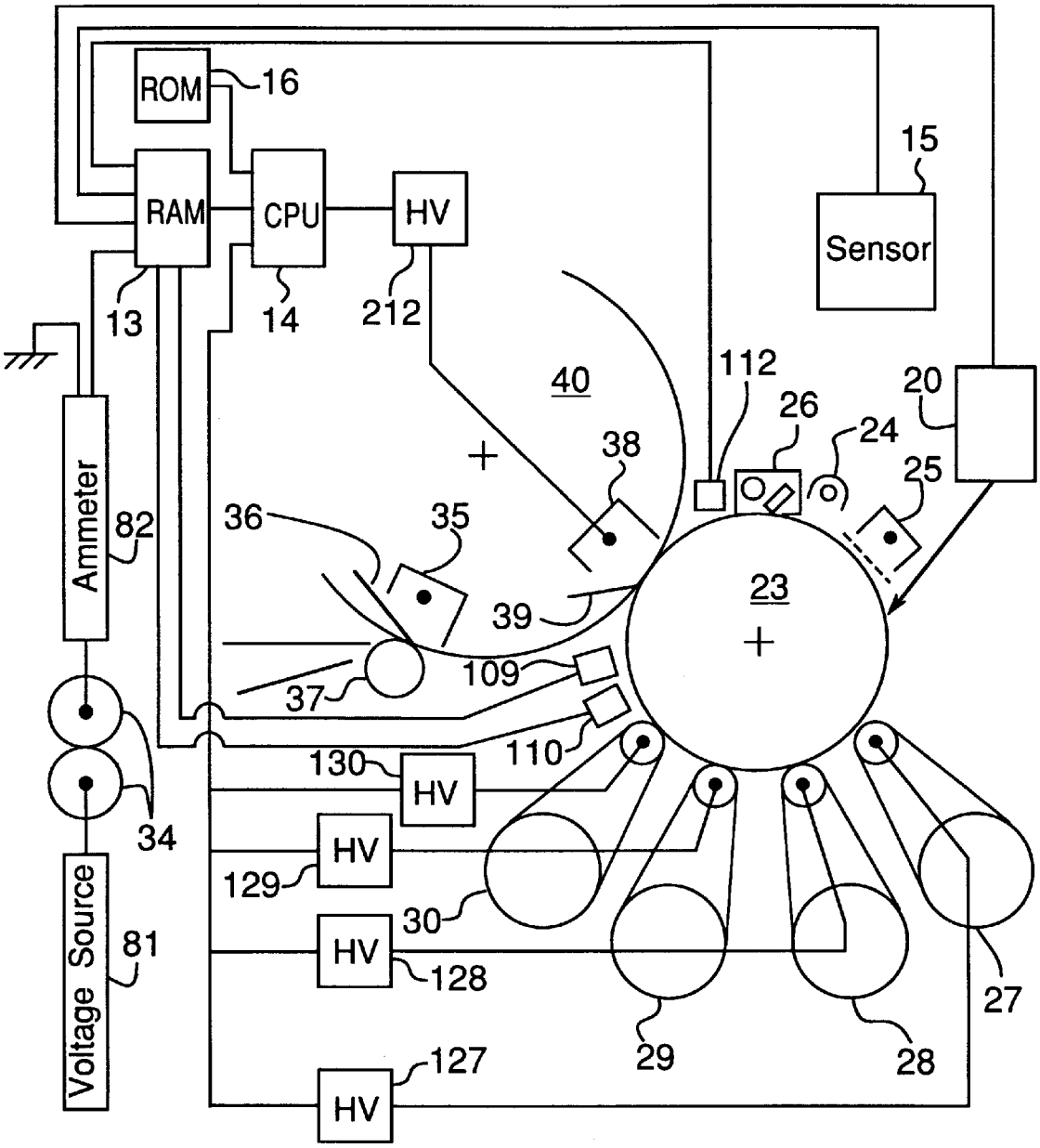
FIG. 21 is a schematic sectional view of a part around the photoconductor drum and the transfer drum of a digital, full color copying machine of a fourth embodiment.

FIG. 21 shows the copying machine in detail near the photoconductor drum 23 and the transfer drum 40 in the fourth embodiment. The same reference numbers are used for the same parts as FIG. 15, and duplicated explanation therefor is omitted. This copying machine is different from that of the second embodiment shown in FIG. 15 in that a sensor 112 for detecting the density of toners remained on the photoconductor drum 23 is provided at the downstream side relative to the transfer point instead of the sensor 213 for detecting toner density on a paper.

Figure 22:
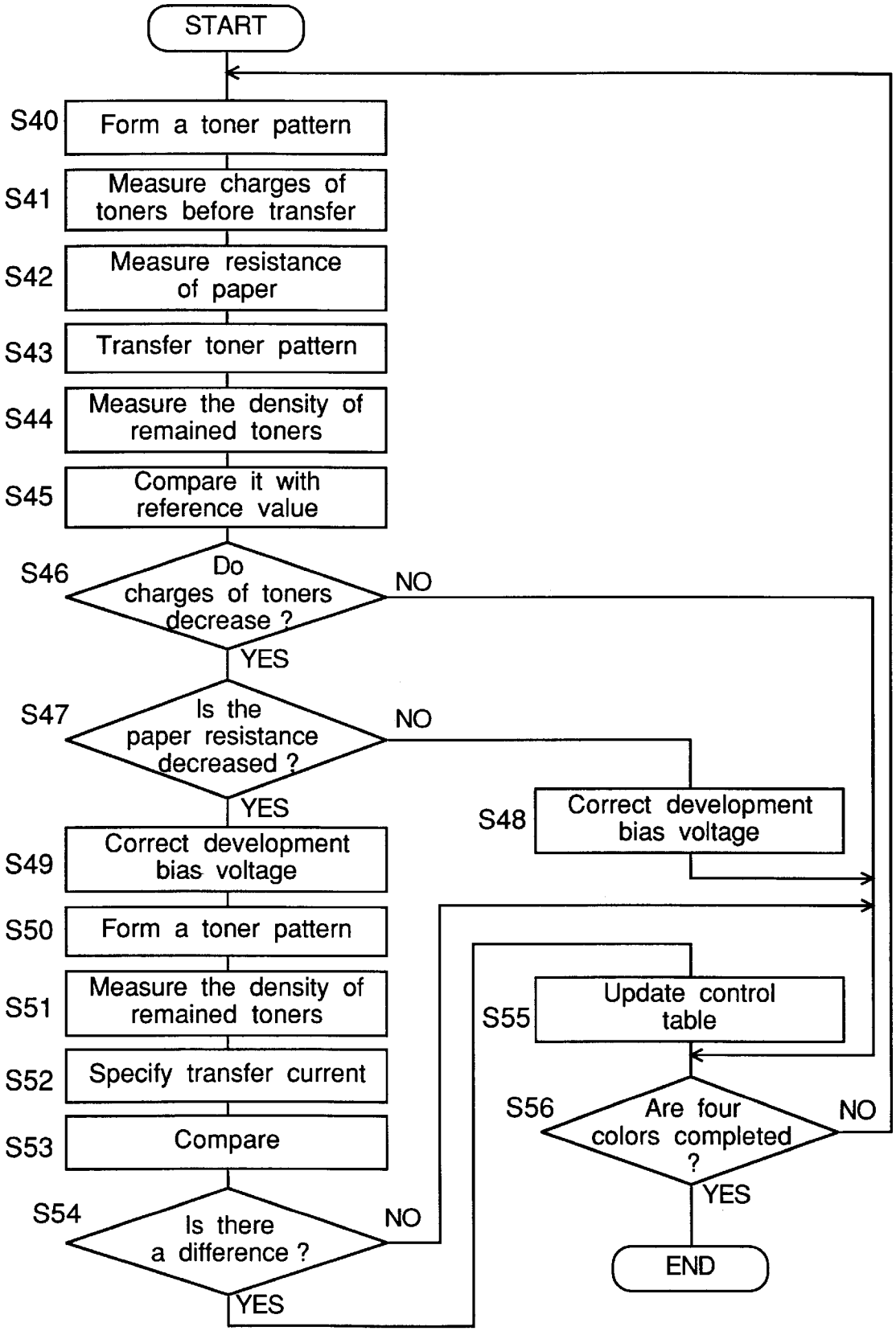
FIG. 22 is a flowchart of the control processing in the fourth embodiment.

FIG. 22 shows the control processing of the CPU 14 when a copy operation is started or a copy mode is set. First, a plurality of toner patterns are formed on the photoconductor drum 23 according to the following procedure (step S40). First, the print head 20 emits a light beam at regular intervals in a constant quantity of light, and latent image patterns P1 to P17 of seventeen lines are formed on the photoconductor drum 23. The latent image patterns P1 to P17 are developed as visible images with the development unit 27 for cyan in the same condition. Next, the amount of toner charges per weight is determined based on the amounts of adhered toners measured with the sensor 109 and the potential of the toner patterns measured with the potential sensor 110 (step S41). In a different way, the development current flowing through the development sleeve is measured on development, and the amount of toner charges per weight is determined based on the measured development current and the amount of adhered toners measured with the sensor 109. Next, the resistance is measured with the ammeter 82 on the paper carried to the timing rollers 34 (step S42). Next, the toner patterns formed on the photoconductor drum 23 are transferred onto the paper wound on the transfer drum 40 by increasing the transfer current stepwise as shown in FIG. 12 (step S43). Next, the toner densities of the toner patterns P1 to P17 remained on the photoconductor drum 23 after transfer are measured with the toner density sensor 112, and the measurement data are stored in the RAM 13 (step S44).

Next, the detected toner density of each toner pattern P1–P17 is compared with the counterpart of toner density which should be realized for the toner pattern for the transfer current selected according to Table 1 based on the absolute humidity detected by the environment sensor 15 (step S45). Then, if the density detected actually is different by a value for example of 0.2 or more, it is decided that the amount of toner charges becomes low (YES at step S46). In such a case, the amount of toner charges is equal to, or smaller than 10 $\mu$C/g and the amount of toner charges is, not appropriate. Then, it is decided next whether the resistance of the paper is smaller than a predetermined value, for example, $10^9\Omega\cdot$cm (step S47). If the resistance of the paper is not smaller than the predetermined value (NO at step 47), only the amount of toner charges is not appropriate. Then, the high voltage sources 127–130 are controlled so that the peak-to-peak voltage $V_{p-p}$ of the sine wave of the development bias voltage is changed from the default value of 2.0 kV to 1.5 kV (step S48). Thus, the amount of charged toners just before transfer becomes larger and the amount of toners remained on the photoconductor drum 23 due to reverse charging become smaller, so that the toner density remained on the photoconductor drum 23 is decreased below a predetermined level as shown with a dashed and dot line shown in FIG. 20.

On the other hand, if the resistance of the paper is decided to be smaller than the predetermined value (YES at step S47), the amount of toner charges becomes low, and the resistance of the paper becomes low. Then, the high voltage sources 127–130 are controlled so that the peak-to-peak voltage $V_{p-p}$ of the sine wave of the development bias voltage is changed from the default value of 2.0 kV to 1.5 kV (step S49). However, this correction may not be sufficient for the appropriate transfer efficiency when the resistance of the paper becomes low. Then, toner patterns are formed again on the paper (step S50), and the toner densities thereof are measured (step S51). Next, the transfer current of the toner pattern having the smallest toner density remained on the photoconductor drum 23 is determined (step S52), and the determined density is compared with the value of the transfer current in Table 1 in correspondence to the absolute humidity detected by the environment sensor 15 (step S53). If a difference is detected (YES at step S54), the control table is updated so that the transfer current determined at step S52 is selected for the absolute humidity detected by the environment sensor 15, and the updated table is written to the RAM 13 (step S25). The CPU 14 controls the transfer current by using the control table written to the RAM 13 until the control table is updated next.

Next, if it is decided that the processing is not complete for the four colors (NO at step S56), the flow returns to step S40, and a series of control processes of steps S40 to S55 is repeated for the remaining colors. The flow ends when it is decided that the processing for four colors is complete (YES at step S56).

In the above-mentioned fourth embodiment, the amount of toner charges and the resistance of the paper are used to decide whether the decrease in transfer efficiency is caused by deterioration of toners or by decrease in the resistance of paper. However, besides the transfer efficiencies of the toner patterns, only one of the amount of toner charges and the resistance of the paper may be detected, and the transfer efficiency and the transfer conditions are controlled according to the detected value of the one of them. For example, only the transfer condition is controlled if the transfer efficiencies and the resistance of the paper are smaller than respective reference values. In this case, the decrease in transfer efficiency is ascribed to decrease in the resistance of paper under high humidity environment. On the other hand, only the development condition is controlled if the transfer efficiencies and the amount of toner charges before transfer are smaller than respective reference values. In this case, the decrease in transfer efficiency is ascribed to deterioration of toners.

Next, a fifth embodiment of the copying machine of the invention is explained. In the copying machine, when a copy operation is started or a copy mode is set, toner patterns of the same density are formed on the photoconductor drum 23, and they are transferred onto a paper and on a film such as overhead projector (OHP) sheet by changing the transfer current for each toner pattern. Then, the toner densities of toner patterns on the paper and on the OHP sheet are detected to represent the transfer efficiency for each transfer current. Then, the development condition and the is transfer condition are controlled according to the detected values.

The copying machine of the fifth embodiment comprises the same component as the copying machine of the first embodiment shown in FIG. 10. Therefore, the duplicated explanation of the components are omitted.

Figure 23:
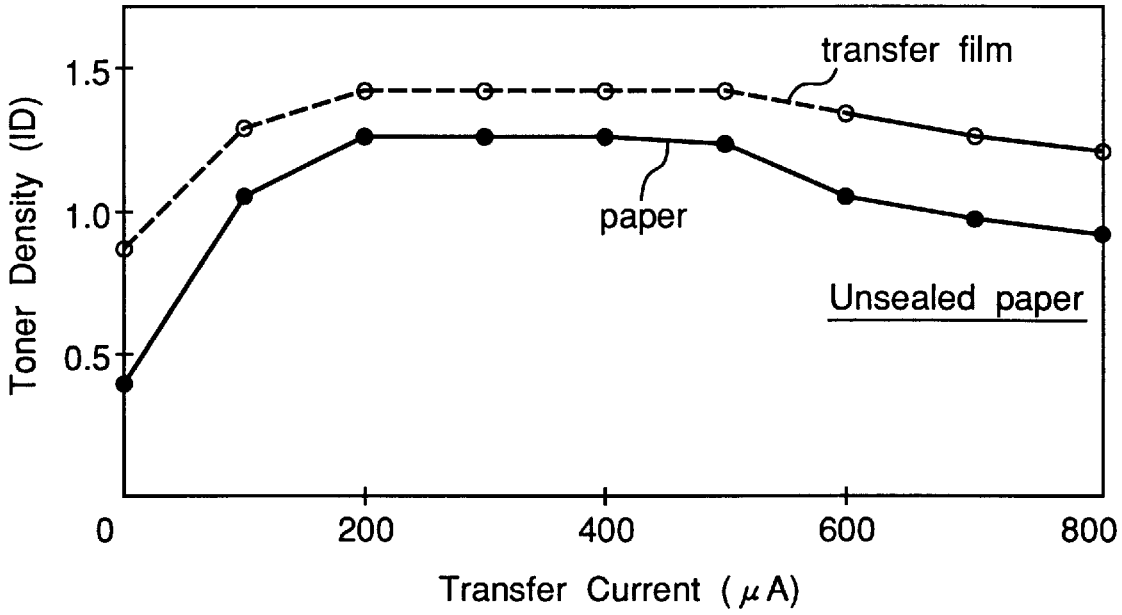
FIG. 23 is a graph where the density of toners transferred onto a transfer material under the environment of 28° C. and 80% RH plotted against transfer current.

The transfer efficiency is explained next when the humidity of a paper is not controlled and when the humidity of a paper is controlled. FIG. 23 is a graph of the amount of toners transferred onto a transfer material according to transfer current under the environment of 28° C. and 80% RH. A curve represented with a solid line shows the amount of toners transferred onto an unsealed paper which have not yet been subjected to humidity control. Moreover, a curve represented with a dashed line shows the amount of toners transferred onto a film such as an OHP sheet. When the data on the paper not subjected to humidity control is compared with those on the film, it is understood that the difference between them is almost constant regardless of the transfer current though the magnitude of the amount is different between the two cases.

Figure 24:
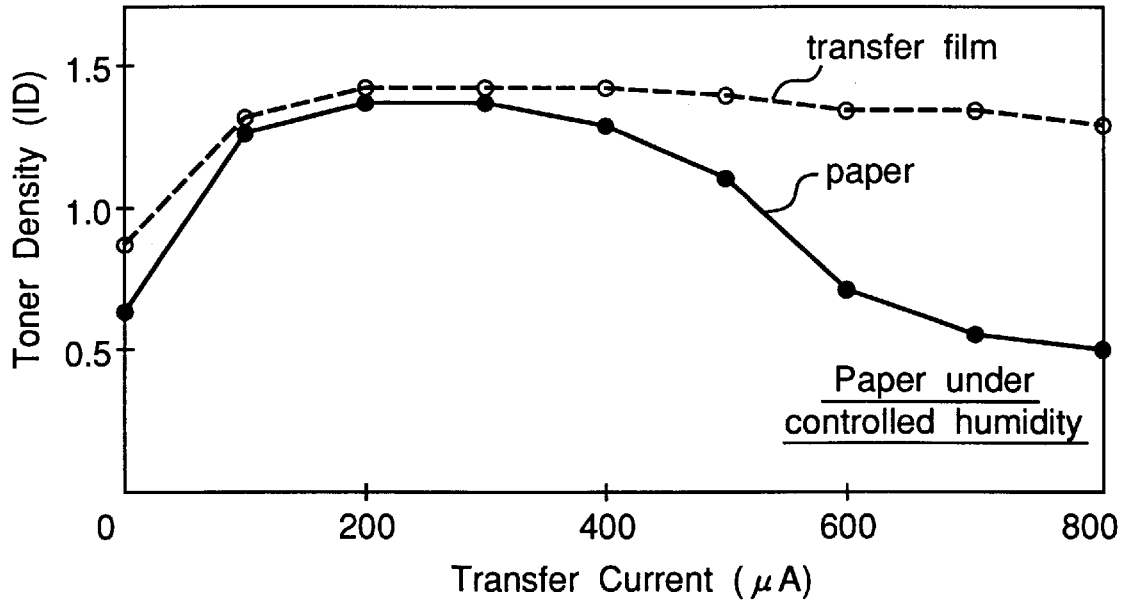
FIG. 24 is a graph of the density of toners transferred onto a transfer material after the apparatus is left for seven or eight hours under the environment of 28° C. and 80% RH to decrease resistance of the paper.

FIG. 24 is a graph of the amount of toners transferred onto a transfer material according to transfer current under the environment of 28° C. and 80% RH. A curve represented with a solid line shows the amount of toners transferred onto a paper which have been subjected to humidity control for seven or eight hours and has a lower resistance. Moreover, a curve represented with a dashed line shows the amount of toners transferred onto a film such as an OHP sheet. When the data on the paper which have been subjected to humidity control is compared with those on the film, it is understood that not only the magnitude of the amount of toners between them but also the magnitude of the difference of the amount of toners between the two transfer materials varies largely with the transfer current.

Then, it can be decided whether the paper is subjected to humidity control and has a lower resistance under high humidity by examining and comparing the amounts of adhered toners to each transfer current on the paper and the film.

Figure 25:
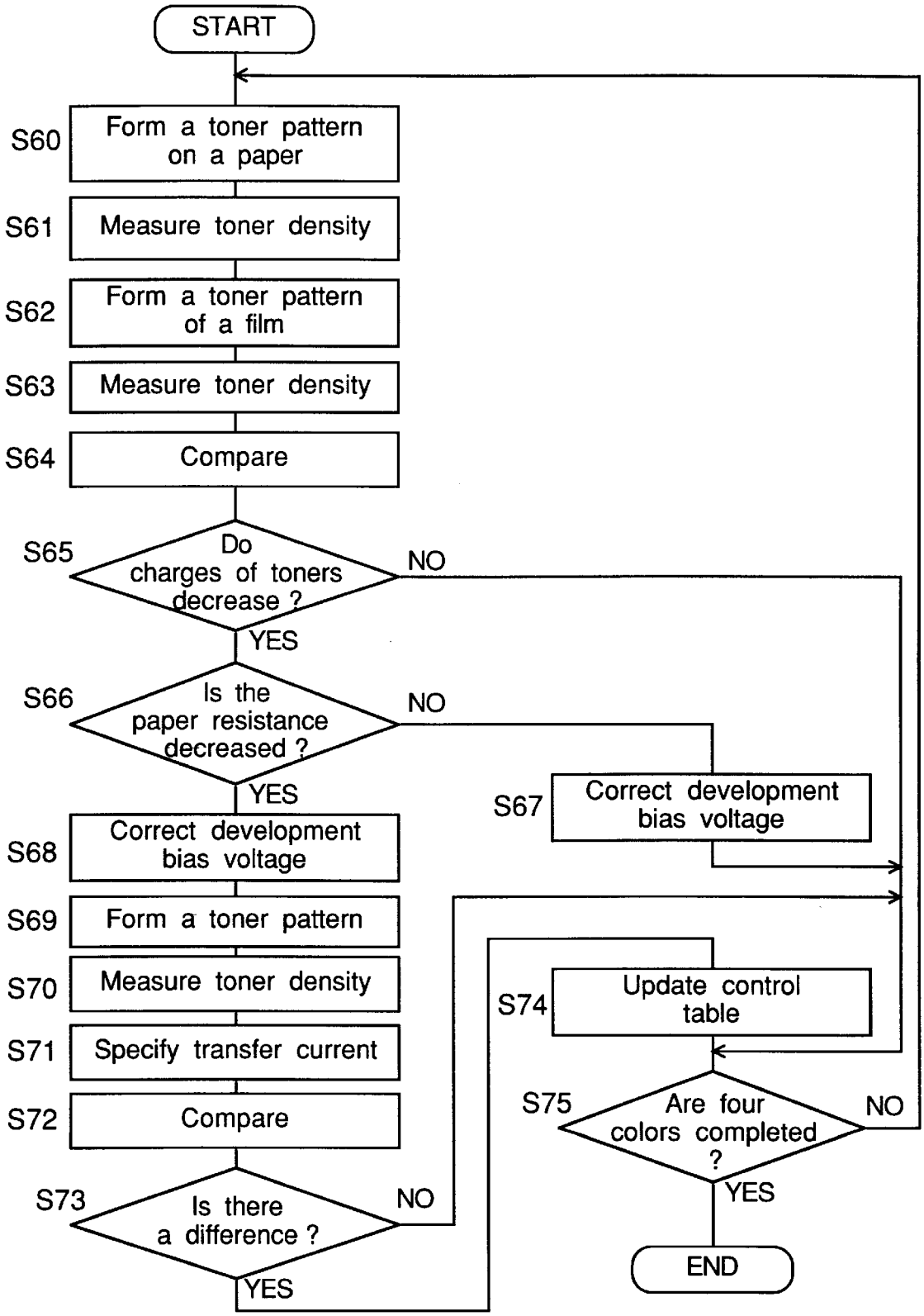
FIG. 25 is a flowchart of the control processing in a fifth embodiment.

FIG. 25 shows the control processing of the CPU 14 when a copy operation is started or a copy mode is set. First, a plurality of toner patterns of the same density are formed on the photoconductor drum 23 with the development unit 27 for cyan and they are transferred on a paper to form toner patterns P1 to P17 shown in FIG. 13 by changing the transfer current stepwise (step S60). Next, the toner densities of the toner patterns P1 to P17 on the paper are measured with the sensor 213 (step S61). Similarly, toner patterns P1 to P17 are formed on a film such as an OHP sheet (step S62), and the toner densities of the toner patterns P1 to P17 on the film are measured with the sensor 213 (step S63). Next, the toner densities of the toner patterns P1 to P17 transferred onto the paper are compared with values of the toner patterns P1 to P17 onto the film (step S64). Then, if the difference between them is about the same irrespective of the transfer current, but if the decrease in toner density is large at high transfer currents for both cases, for example, if a difference between the maximum density and the density for the transfer current of 700 $\mu$A is 0.5 or more for both cases, it is decided that the amount of toner charges becomes low (YES at step S65) and the amount of toner charges is not appropriate. Then, it is decided next whether the resistance of the paper is smaller than a predetermined value, for example, $10^9\Omega\cdot$cm (step S66). If the resistance of the paper is not smaller than the predetermined value (NO at step S66), only the amount of toner charges is not appropriate. Then, the high voltage sources 127–130 are controlled so that the peak-to-peak voltage $V_{p-p}$ of the sine wave of the development bias voltage is changed from the default value of 2.0 kV to 1.5 kV (step S67). Thus, the amount of charged toners after development and just before transfer becomes larger and the amount of toners remained on the photoconductor drum 23 due to reverse charging become smaller, so that the transfer efficiency is enhanced.

On the other hand, if the resistance of the paper is decided to be smaller than the predetermined value (YES at step S66), it is decided that the amount of toner charges becomes low, and the resistance of the paper becomes low. For example, such a case occurs when a difference between the maximum density and the density for the transfer current of 700 $\mu$A is 0.5 or more for both cases and the difference of toner densities on the paper and on the film is 0.2 or more. In such a case, the difference between the toner densities varies with the transfer current largely. Then, the high voltage sources 127–130 are controlled so that the peak-to-peak voltage $V_{p-p}$ of the sine wave of the development bias voltage is changed from the default value of 2.0 kV to 1.5 kV (step S68). However, this correction may not be sufficient for the appropriate transfer efficiency when the resistance of the paper becomes low. Then, toner patterns are formed again on the paper (step S69), and the toner densities thereof are measured (step S70). Next, the transfer current of the toner pattern having the largest toner density is determined (step S71), and the determined density is compared with, the value of the transfer current in Table 1 in correspondence to the absolute humidity detected by the environment sensor 15 (step S72). If a difference is detected (YES at step S73), the control table is updated so that the transfer current determined at step S71 is selected for the absolute humidity detected by the environment sensor 15, and the updated table is written to the RAM 13 (step S74). The CPU 14 controls the transfer current by using the control table written to the RAM 13 until the control table is updated next.

Next, if it is decided that the processing is not complete for the four colors (NO at step S75), the flow returns to step S60, and a series of control processes of steps S60 to S74 is repeated for the remaining colors. The flow ends when it is decided that the processing for four colors is complete (YES at step S75).

Next, a sixth embodiment of the copying machine of the invention is explained. In the copying machine, when a copy operation is started or a copy mode is set, toner patterns of the same density are formed on the photoconductor drum 23, and they are transferred onto a paper and on a film such as an OHP sheet by changing the transfer current for each toner pattern. Then, the toner densities of toner patterns remained on the photoconductor are detected to represent the transfer efficiency for each transfer current. Then, the development condition and the transfer condition are controlled according to the detected values.

The copying machine of the fifth embodiment comprises the same component as the copying machine of the third embodiment shown in FIG. 17. Therefore, the duplicated explanation of the components are omitted. The toner densities of toner patterns remained on the photoconductor are detected with a sensor 112 after the toner patterns are transferred to a paper and to a film. The measured information is sent to the RAM 13 and to the CPU 14.

Figure 26:
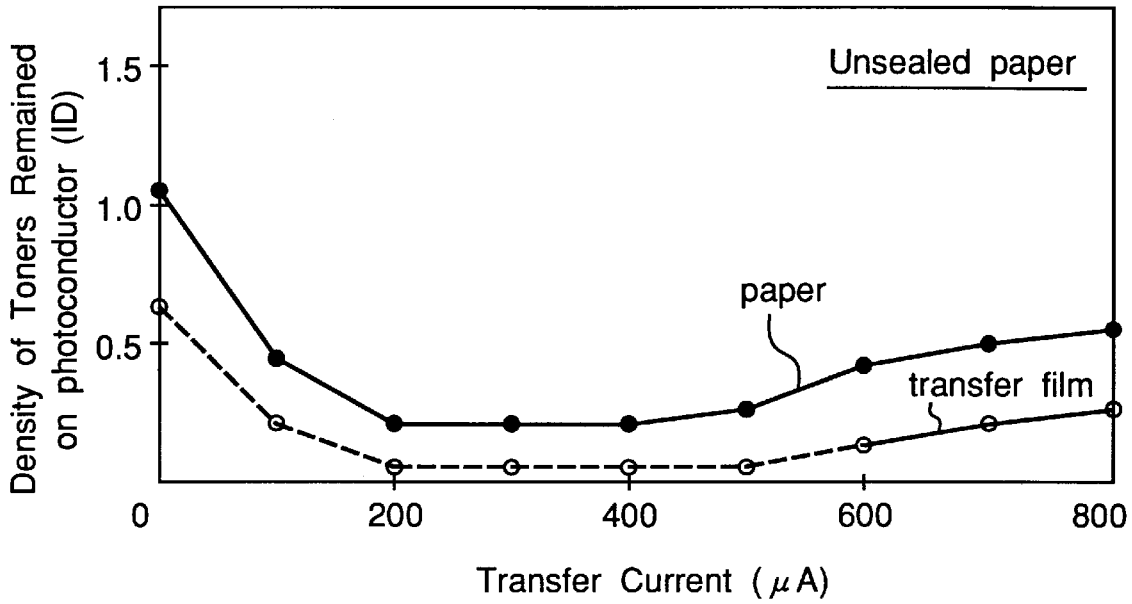
FIG. 26 is a graph where the amount of toners remained on the photoconductor drum after transfer of toner patterns to a transfer material under the environment of 28° C. and 80% RH plotted against transfer current.

Next, the transfer efficiency is explained when the humidity of a paper is not controlled and when the humidity of a paper is controlled. FIG. 26 is a graph of the amount of toners remained on the photoconductor drum 23 after transfer onto a transfer material according to transfer current under the environment of 28° C. and 80% RH. A curve represented with a solid line shows the amount of toners remained on the photoconductor drum 23 after transfer onto an unsealed paper which have not yet been subjected to humidity control. Moreover, a curve represented with a dashed line shows the amount of toners remained after transfer onto a film such as an OHP sheet. When the data on the paper not subjected to humidity control is compared with those on the film, it is understood that the difference between them is almost constant regardless of the transfer current though the magnitude of the amount is different between the two cases.

Figure 27:
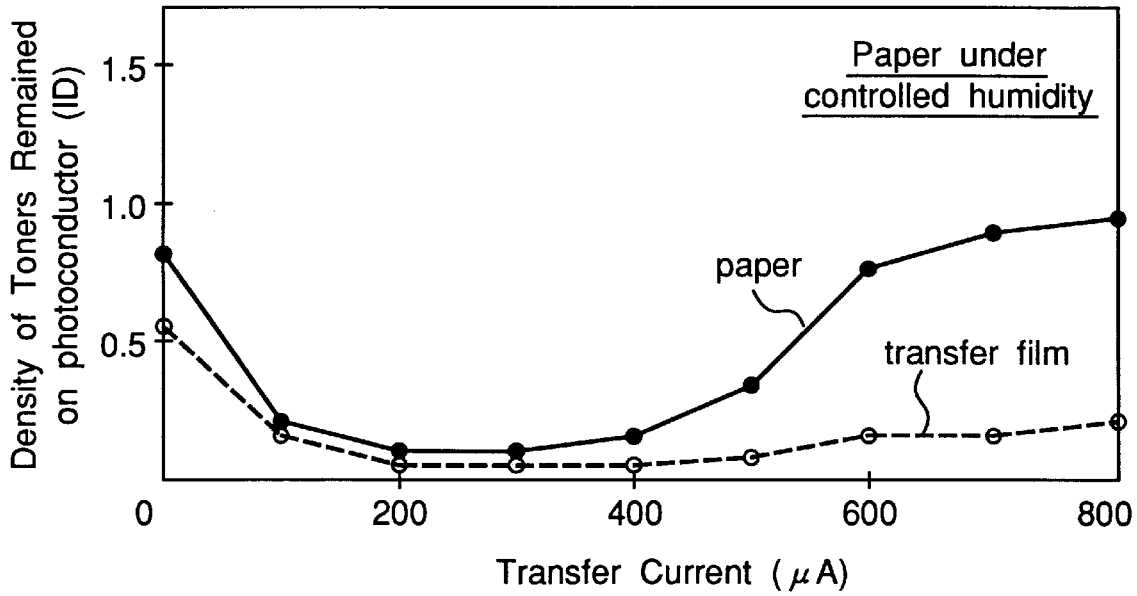
FIG. 27 is a graph of the density of toners remained on the photoconductor drum after transfer of toner patterns to a transfer material after the apparatus is left for seven or eight hours under the environment of 28° C. and 80% RH to decrease resistance of the paper.

FIG. 27 is a graph of the amount of toners transferred onto a transfer material according to transfer current under the environment of 28° C. and 80% RH. A curve represented with a solid line shows the amount of toners remained on the photoconductor drum 23 after transfer onto a paper which have been subjected to humidity control for 7 to 8 hours and has a lower resistance. Moreover, a curve represented with a dashed line shows the amount of toners remained on the photoconductor drum 23 after transfer onto a film such as an OHP sheet. When the data on the paper which have been subjected to humidity control is compared with those on the film, it is understood that not only the magnitude of the amount of remained toners between them but also the magnitude of the difference of the amount of remained toners between the two transfer materials varies largely with the transfer current.

Then, it can be decided whether the paper is subjected to humidity control and has a lower resistance under high humidity by examining and comparing the amounts of remained toners to each transfer current on the paper and the film.

Figure 28:
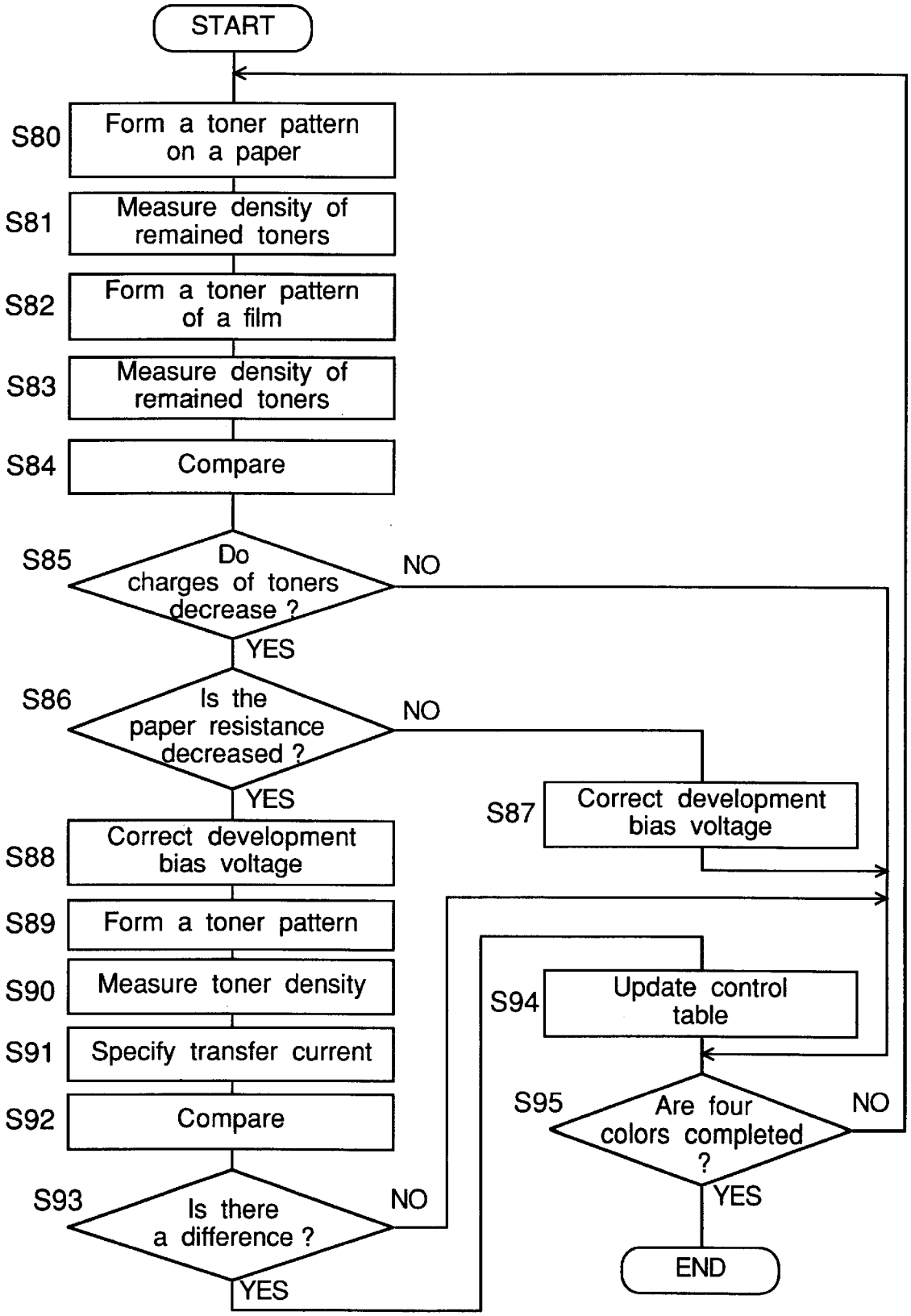
FIG. 28 is a flowchart of the control processing in a sixth embodiment.

FIG. 28 shows the control processing of the CPU 14 when a copy operation is started or a copy mode is set. First, a plurality of toner patterns of the same density are formed on the photoconductor drum 23 with the development unit 27 for cyan and they are transferred on a paper to form toner patterns P1 to P17 shown in FIG. 13 by changing the transfer current stepwise (step S80). Next, the toner densities of the toner patterns P1 to P17 remained on the photoconductor drum 23 after transfer onto the paper are measured with the sensor 213 (step S81). Similarly, toner patterns P1 to P17 are formed on a film such as an OHP sheet (step S82), and the toner densities of the toner patterns P1 to P17 remained on the photoconductor drum 23 after transfer onto the film are measured with the sensor 213 (step S83). Next, the toner densities of the toner patterns P1 to P17 remained on the photoconductor drum 23 after transfer onto the paper are compared with values of the toner patterns P1 to P17 remained on the photoconductor drum 23 after transfer onto the film (step S84). Then, if the difference between them is about the same irrespective of the transfer current, but if the increase in toner density is large at high transfer currents for both cases, for example, if a difference between the minimum density and the density for the transfer current of 700 $\mu$A is 0.5 or more for both cases, it is decided that the amount of toner charges becomes low (YES at step S85) or the amount of toner charges is not appropriate. Then, it is decided next whether the resistance of the paper is smaller than a predetermined value, for example, $10^9\Omega\cdot$cm (step S86). If the resistance of the paper is not smaller than the predetermined value (NO at step S86), only the amount of toner charges is not appropriate. Then, the high voltage sources 127–130 are controlled so that the peak-to-peak voltage $V_{p\text{-}p}$ of the sine wave of the development bias voltage is changed from the default value of 2.0 kV to 1.5 kV (step S87). Thus, the amount of charged toners after development and just before transfer becomes enhanced and the amount of toners remained on the photoconductor drum 23 due to reverse charging become smaller than a predetermined level, so that the transfer efficiency is enhanced.

On the other hand, if the resistance of the paper is decided to be smaller than the predetermined value (YES at step S86), it is decided that the amount of toner charges becomes low, and the resistance of the paper becomes low. For example, such a case occurs when a difference between the minimum density and the density for the transfer current of 700 $\mu$A is 0.5 or more for both cases and the difference of toner densities remained after transfer onto the paper and onto the film is 0.2 or more. In such a case, the difference between the toner densities varies with the transfer current largely. Then, the high voltage sources 127–130 are controlled so that the peak-to-peak voltage $V_{p\text{-}p}$ of the sine wave of the development bias voltage is changed from the default value of 2.0 kV to 1.5 kV (step S88). However, this correction may not be sufficient for the appropriate transfer efficiency when the resistance of the paper becomes low. Then, toner patterns P1 to P17 are formed again on the paper (step S89), and the toner densities thereof remained on the photoconductor drum 23 are measured (step S90). Next, the transfer current of the toner pattern having the smallest toner density is determined (step S91), and the determined density is compared with the value of the transfer current in Table 1 in correspondence to the absolute humidity detected by the environment sensor 15 (step S92). If a difference is detected (YES at step S73), the control table is updated so that the transfer current determined at step S91 is selected for the absolute humidity detected by the environment sensor 15, and the updated table is written to the RAM 13 (step S94). The CPU 14 controls the transfer current by using the control table written to the RAM 13 until the control table is updated next.

Next, if it is decided that the processing is not complete for the four colors (NO at step S95), the flow returns to step S80, and a series of control processes of steps S80 to S94 is repeated for the remaining colors. The flow ends when it is decided that the processing for four colors is complete (YES at step S85).

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An electrophotographic image forming apparatus comprising:

a photoconductor;

an exposure device for forming a plurality of latent images on said photoconductor;

a development unit developing the latent images to form a plurality of toner images on said photoconductor;

a transfer device for transferring the toner images on said photoconductor onto a paper while changing transfer current of said transfer device for each of the toner patterns;

a transfer efficiency detector for detecting transfer efficiency for each of the toner patterns based on an amount of toners remained on said photoconductor after the toner patterns are transferred onto the paper;

a resistance detector for detecting resistance of the paper;

a charge detector for detecting an amount of charges of the toner patterns formed on said photoconductor before transfer; and a controller for controlling a development condition of said development unit and/or a transfer condition of said transfer device based on the transfer efficiencies of the toner patterns detected by said transfer efficiency detector and at least one of the resistance detected by said resistance detector and the amount of toner charges detected by said charge detector.

2. The electrophotographic image forming apparatus according to claim 1, wherein said controller controls the development condition when the transfer efficiencies satisfy a predetermined condition and the amount of toner charges is smaller than a predetermined value and said controller controls the transfer condition when the resistance of the paper is smaller than a predetermined value.

3. The electrophotographic image forming apparatus according to claim 1, wherein said transfer efficiency detector detects the transfer efficiency of each of the toner patterns based on an amount of toners of the toner patterns transferred onto the paper.

4. The electrophotographic image forming apparatus according to claim 1, wherein said transfer efficiency detector detects the transfer efficiency of each of the toner patterns based on an amount of toners remained on said photoconductor after the toner patterns are transferred onto the paper.

5. A method for forming an electrophotographic image comprising the steps of:

forming a plurality of latent images with the same optical intensity on a photoconductor;

developing the latent images to form a plurality of toner images on the photoconductor;

transferring the toner images on said photoconductor onto a paper by changing transfer current of a transfer device for each of the toner patterns;

detecting transfer efficiency of each of the toner patterns;

detecting resistance of the paper;

detecting an amount of charges of the toner patterns formed on the photoconductor before transfer; and controlling a development condition of a development unit and/or a transfer condition of the transfer device based on the transfer efficiencies of the toner patterns detected by said transfer efficiency detector and at least one of the resistance detected by said resistance detector and the amount of toner charges detected by said charge detector, wherein the development condition is controlled when the transfer efficiencies satisfy a predetermined condition and the amount of toner charges is smaller than a predetermined value and the transfer condition is controlled when the resistance of the paper is smaller than a predetermined value.

6. An electrophotographic image forming apparatus comprising:

a photoconductor;

an exposure device for forming a plurality of latent images on said photoconductor;

a development unit developing the latent images to form a plurality of toner images on said photoconductor;

a transfer device for transferring the toner images on said photoconductor onto a paper and onto a film;

a transfer controller for transferring the toner patterns onto the paper and onto the film while changing transfer current of said transfer device for each of the toner patterns;

a detector for detecting transfer efficiencies on transfer onto the paper and on transfer onto the film;

a comparator comparing the transfer efficiencies on the transfer onto the paper with the counterparts on transfer onto the film detected by said detector; and a controller for controlling a development condition of said development unit and a transfer condition of said transfer device based on comparison by said comparator.

7. The electrophotographic image forming apparatus according to claim 6, wherein said detector detects the transfer efficiency of each of the toner patterns based on an amount of toners of the toner patterns transferred onto the paper.

8. The electrophotographic image forming apparatus according to claim 6, wherein said detector detects the transfer efficiency of each of the toner patterns based on an amount of toners remained on said photoconductor after the toner patterns are transferred onto the paper.

9. A method for forming an electrophotographic image comprising the steps of:

forming a plurality of latent images with the same optical intensity on a photoconductor;

developing the latent images to form a plurality of toner images on the photoconductor;

transferring the toner images on the photoconductor onto a paper and onto a film while changing transfer current of a transfer device for each of the toner patterns to transfer the each of the toner patterns onto the paper and onto the film;

detecting transfer efficiencies on transfer onto the paper and on transfer onto the film;

comparing the transfer efficiencies on the transfer onto the paper with the counterparts on transfer onto the film; and controlling a development condition of said development unit and a transfer condition of the transfer device based on the comparison of the transfer efficiencies on the transfer onto the paper with the counterparts on transfer onto the film.

10. An electrophotographic image forming apparatus comprising:

a photoconductor;

an exposure device for forming a plurality of latent images on said photoconductor;

a development unit developing the plurality of latent images to form a plurality of toner images on said photoconductor;

a transfer device for transferring the toner images on said photoconductor onto a paper while changing transfer current of said transfer device for each of the toner patterns;

a detector for detecting transfer efficiency of each of the toner patterns transferred onto the paper;

a resistance detector for detecting resistance of the paper; and a development controller for controlling a development condition of said development unit based on the transfer efficiencies of the toner patterns detected by said detector, wherein said development controller controls a development bias voltage of said development voltage and a frequency of an alternating voltage.

11. The electrophotographic image forming apparatus according to claim 10, wherein said detector detects the transfer efficiency of each of the toner patterns based on an amount of toners of the toner patterns transferred onto the paper.

12. The electrophotographic image forming apparatus according to claim 10, wherein said detector detects the transfer efficiency of each of the toner patterns based on an amount of toners remained on said photoconductor after the toner patterns are transferred onto the paper.

13. An electrophotographic image forming apparatus comprising:

a photoconductor;

an exposure device for forming a plurality of latent images on said photoconductor;

a development unit developing the plurality of latent images to form a plurality of toner images on said photoconductor;

a transfer device for transferring the toner images on said photoconductor onto a paper while changing transfer current of said transfer device for each of the toner patterns;

a detector for detecting transfer efficiency of each of the toner patterns transferred onto the paper;

a resistance detector for detecting resistance of the paper; and a development controller for controlling a development condition of said development unit based on the transfer efficiencies of the toner patterns detected by said detector, wherein said development controller controls a development bias voltage of said development voltage and a magnitude of an alternating voltage.

14. The electrophotographic image forming apparatus according to claim 13, further comprising:

a humidity sensor for detecting humidity in the image forming apparatus; and a transfer controller controlling said transfer device according to the humidity detected by said humidity sensor.

15. The electrophotographic image forming apparatus according to claim 14, wherein said transfer controller decreases the transfer current of said transfer device when the humidity detected by said humidity sensor is high and increases the transfer current of said transfer device when the humidity detected by said humidity sensor is low.

16. The electrophotographic image forming apparatus according to claim 13, wherein said detector detects the transfer efficiency of each of the toner patterns based on an amount of toners of the toner patterns transferred onto the paper.

17. The electrophotographic image forming apparatus according to claim 13, wherein said detector detects the transfer efficiency of each of the toner patterns based on an amount of toners remained on said photoconductor after the toner patterns are transferred onto the paper.

18. An electrophotographic image forming apparatus comprising:

a photoconductor;

an exposure device for forming a plurality of latent images on said photoconductor;

a development unit developing the plurality of latent images to form a plurality of toner images on said photoconductor;

a transfer device for transferring the toner images on said photoconductor onto a paper while changing transfer current of said transfer device for each of the toner patterns;

a detector for detecting transfer efficiency of each of the toner patterns transferred onto the paper;

a resistance detector for detecting resistance of the paper; and a development controller for controlling a development condition of said development unit based on the transfer efficiencies of the toner patterns detected by said detector, wherein said development controller controls a development bias voltage of said development voltage, and wherein the development bias voltage has a pulse voltage.

19. The electrophotographic image forming apparatus according to claim 18, wherein said development controller controls a pulse width of the pulse voltage.

20. The electrophotographic image forming apparatus according to claim 18, wherein said development controller controls a pulse frequency of the pulse voltage.

21. The electrophotographic image forming apparatus according to claim 18, further comprising:

a humidity sensor for detecting humidity in the image forming apparatus; and a transfer controller controlling said transfer device according to the humidity detected by said humidity sensor.

22. The electrophotographic image forming apparatus according to claim 21, wherein said transfer controller decreases the transfer current of said transfer device when the humidity detected by said humidity sensor is high and increases the transfer current of said transfer device when the humidity detected by said humidity sensor is low.

23. The electrophotographic image forming apparatus according to claim 18, wherein said detector detects the transfer efficiency of each of the toner patterns based on an amount of toners of the toner patterns transfer red onto the paper.

24. The electrophotographic image forming apparatus according to claim 18, wherein said detector detects the transfer efficiency of each of the toner patterns based on an amount of toners remained on said photoconductor after the toner patterns are transferred onto the paper.

25. A method for forming an electrophotographic image comprising the steps of:

forming a plurality of latent images on a photoconductor;

developing the latent images to form a plurality of toner patterns on the photoconductor;

transferring the toner images on said photoconductor onto a paper while changing a transfer current for each of the toner patterns;

detecting transfer efficiency for each of the toner patterns transferred onto the paper; and controlling a development condition based on the detected transfer efficiencies of the toner patterns by varying a frequency of an alternating voltage that is provided for a development bias voltage.

26. A method for forming an electrophotographic image comprising the steps of:

forming a plurality of latent images on a photoconductor;

developing the latent images to form a plurality of toner patterns on the photoconductor;

transferring the toner images on said photoconductor onto a paper while changing a transfer current for each of the toner patterns;

detecting transfer efficiency for each of the toner patterns transferred onto the paper; and controlling a development condition based on the detected transfer efficiencies of the toner patterns by varying a magnitude of an alternating voltage that is provided for a development bias voltage.

* * * * *